US011240620B2

(12) United States Patent
Hamm

(10) Patent No.: US 11,240,620 B2
(45) Date of Patent: Feb. 1, 2022

(54) METHODS FOR MAKING SPATIAL MICROPHONE SUBASSEMBLIES, RECORDING SYSTEM AND METHOD FOR RECORDING LEFT AND RIGHT EAR SOUNDS FOR USE IN VIRTUAL REALITY PLAYBACK

(71) Applicant: Russel O. Hamm, New York, NY (US)

(72) Inventor: Russel O. Hamm, New York, NY (US)

( * ) Notice: Subject to any disclaimer, the term of this patent is extended or adjusted under 35 U.S.C. 154(b) by 0 days.

(21) Appl. No.: 16/855,750

(22) Filed: Apr. 22, 2020

(65) Prior Publication Data

US 2020/0389751 A1 Dec. 10, 2020

Related U.S. Application Data

(63) Continuation of application No. PCT/US2018/057102, filed on Oct. 23, 2018.

(60) Provisional application No. 62/734,542, filed on Sep. 21, 2018, provisional application No. 62/575,824, filed on Oct. 23, 2017.

(51) Int. Cl.

| | |
|---|---|
| ***H04S 7/00*** | (2006.01) |
| ***H04R 1/08*** | (2006.01) |
| ***H04R 5/027*** | (2006.01) |

(52) U.S. Cl.

CPC ..... *H04S 7/30* (2013.01); *H04R 1/083* (2013.01); *H04R 5/027* (2013.01); *H04S 2400/15* (2013.01); *H04S 2420/01* (2013.01)

(58) Field of Classification Search

None

See application file for complete search history.

(56) References Cited

U.S. PATENT DOCUMENTS

| | | | | |
|---|---|---|---|---|
| 2007/0003095 A1* | 1/2007 | Slamka | ..... | H04R 1/086 381/381 |
| 2009/0110227 A1* | 4/2009 | Prince | ..... | H04R 1/105 381/380 |
| 2010/0086165 A1* | 4/2010 | Wilson | ..... | H04R 1/105 381/374 |

(Continued)

OTHER PUBLICATIONS

Primo, "Electret Condenser Microphone EM272." pp. 1-8. Jul. 2017. https://micbooster.com/primo-microphone-capsules/111-stereo-primo-em172-module-35-mm-plug-thin-cable.html (Year: 2017).*

*Primary Examiner* — Qin Zhu

(74) *Attorney, Agent, or Firm* — J. Andrew McKinney, Jr.

(57) ABSTRACT

A sound field recording system 100 and method for sound recording includes a paired spherical acoustic pressure sensor assembly 120. A user wears paired transducer assembly 120 during recording in a position which captures a sonic image or sound-field the way the user hears it. Sound field recording system 100 effectively captures and encodes a surprisingly uniform Head Related Transfer Function ("HRTF") into an audio recording. The paired spherical acoustic pressure sensor assembly 120 includes transducers 130, 140 which are worn over the ears on opposing sides of a person's head, carried on left and right side cable temple defining ear hook members 132, 142, and suspended in front of the ear canals in front of the tragus. System 100 and the method of the present invention enable users to make audio-visual recordings having an aural perspective which is substantially constant and fixed in relation to a contemporaneous video recording.

5 Claims, 23 Drawing Sheets

(56) References Cited

U.S. PATENT DOCUMENTS

| | | | | |
|---|---|---|---|---|
| 2010/0245624 | A1* | 9/2010 | Beaucoup | H04N 5/772 348/231.4 |
| 2011/0129097 | A1* | 6/2011 | Andrea | G10K 11/175 381/71.6 |
| 2013/0028462 | A1* | 1/2013 | Chen | H04R 1/1083 381/375 |
| 2014/0064510 | A1* | 3/2014 | Grinnip, III | H04R 1/1066 381/74 |
| 2015/0078556 | A1* | 3/2015 | Shenoy | G06F 3/16 381/56 |
| 2015/0215694 | A1* | 7/2015 | Lin | H04R 1/1033 381/370 |
| 2015/0222978 | A1* | 8/2015 | Murozaki | H04R 1/1016 381/380 |
| 2015/0319525 | A1* | 11/2015 | O'Polka | G10K 11/28 381/300 |
| 2015/0382100 | A1* | 12/2015 | Azmi | H04R 1/1091 381/380 |
| 2016/0050477 | A1* | 2/2016 | Ushakov | H04R 1/105 381/380 |
| 2017/0105062 | A1* | 4/2017 | Lamb | H04R 1/105 |

* cited by examiner

6
Slide SPHERE onto unit until it is flush with the SENSOR.

7
Push O-RING up to base of SPHERE. Be sure SENSOR remains flush with SPHERE.

8
Remove SPHERE.

9
Squirt EPOXY onto open wiring.

10
Carefully replace SPHERE rotating to distribute EPOXY evenly.

11
After EPOXYsets,
Cut the base off the
STEEL WIRE.

12
Slide SHRINK-LABEL-L& R
up CABLE and halfway
onto PUR-TUBE.

13
Use a HEATGUN to
shrink the SHRINK-LABEL-L& R.

METHODS FOR MAKING SPATIAL MICROPHONE SUBASSEMBLIES, RECORDING SYSTEM AND METHOD FOR RECORDING LEFT AND RIGHT EAR SOUNDS FOR USE IN VIRTUAL REALITY PLAYBACK

PRIORITY CLAIMS AND RELATED APPLICATION INFORMATION

This application is a Continuation of and claims priority benefit to:

(a) commonly owned US PCT patent application number PCT/US18/57102 which is entitled "Improved methods for making Spatial Microphone subassemblies, Recording System and Method for Recording Left and Right Ear Sounds for use in Virtual Reality ("VR") Playback" and was filed on 23 Oct. 2018, which claims priority to (b) commonly owned U.S. provisional patent application No. 62/575,824 which is entitled Sonic Presence Spatial Microphone, System and Method for Recording Left and Right Ear Sounds for use in Virtual Reality ("VR") Playback, and was filed on Oct. 23, 2017, and (c) commonly owned U.S. provisional patent application No. 62/734,542 which is entitled Improved methods for making Sonic Presence Spatial Microphone, System and Method for Recording Left and Right Ear Sounds for use in Virtual Reality ("VR") Playback, and was filed on Sep. 21, 2018, the entire disclosures of which are all incorporated herein by reference.

BACKGROUND OF THE INVENTION

Field of the Invention

The present invention relates to audio recording and more specifically to transducer systems and methods for making Virtual Reality ("VR") audio-visual recordings having ambient soundscapes with an aural perspective which is substantially constant and fixed in relation to a contemporaneous video recording.

Discussion of the Prior Art

Audiovisual recordings with multichannel (e.g., stereo) sound are very common and can be entertaining, but do not provide an immersive experience in which the audience member or viewer feels immersed in the recorded environment. The principal problem with prior art methods and systems for recording (e.g., stereo or binaural) audio was and remains that when listening to the recording on headphones or with earbuds, the sound appears to be trapped inside the listener's head.

Microphones are transducers which transform variations in sound pressure into an electrical signal with two dimensions: pitch and amplitude. These are the same two dimensions a listener hears with one ear. For humans, sensitivity to pitch covers a range of 10 octaves starting at a frequency of 20 Hz in the low bass and extending to 20,000 Hz in the upper harmonics and sensitivity to amplitude exceeds a range of 100,000 to 1. That's a range that begins with a quiet whisper and builds in intensity to the painful noise of a jackhammer. Humans have two ears connected to the brain. This combination enables the listener's sense of hearing to tell more about sounds than just the pitch and amplitude. The listener in an ambient sound field can locate sounds in three-dimensional space.

Sound Localization

Over one hundred years ago, Lord Rayleigh in his treatise "Duplex Theory of Sound Localization," described the basic principles of how listeners hear sounds coming from different directions. There were two main principles (hence the word "duplex"). The first principle is time difference. When a sound originates from a source directly to the listener's right, it is heard first with the right ear and then, a fraction of a second later, with the left ear. The time difference is miniscule, about 600 millionths of a second, but the listener's mind can detect it. The scientific terminology for this time difference is: Interaural Time Difference (ITD).

The second principle is level difference. Because there's a head located between listeners' ears, the sound coming from the source on the listener's right will be louder in the right ear and softer when it arrives at the left ear. That's because the listener's head blocks the sound creating a level difference or shadow. This level difference is not so simple to understand as the time difference. The listener's head is almost spherically shaped. Its interaction with sound waves creates level differences that are frequency dependent and quite complex. The listener's mind is amazingly sensitive to these level differences. The scientific terminology is: Interaural Level Difference (ILD).

There is a vast body of scientific literature written during the last century analyzing the interaction of waves with rigid bodies. The applicant has studied these works to gain an understanding of how sound waves behave when they encounter a spherical object, specifically the listener's head. Sound waves create pressure zones as they impinge upon and pass around the head. These effects influence the listener's sense of direction for sounds, creating a sense of spaciousness and presence. Understanding the literature requires an understanding of the anatomy of the human ear, as illustrated in FIGS. 1A and 1B. FIG. 1A is a diagram excerpt from Gray's Anatomy showing the anatomical features of the outer ear including the Pinna's Helix and Scapha. FIG. 2B is a diagram excerpt showing the anatomical features of the outer (external) ear, the middle ear (including the ear canal or external auditory meatus) and the internal ear. Those terms will be part of the nomenclature of the method of the present invention, as described and illustrated below.

Current Stereo Techniques

Stereo sound recordings became widespread in the late 1950s, although their invention dates to the 1930s. In concept, stereo recording is supposed to capture sounds and reproduce them in a way that recreates the "live experience" as if the listener were there. The listener has two ears, so the theory behind stereo says that two channels of sound should be satisfactory. "Stereo" is usually defined as a method for recording sound with two channels using two microphones and reproducing the sound with two earphones or loudspeakers. Ideally, one microphone captures sounds originating from the left, directing them towards the left ear, and the second microphone captures sounds on the right directing them to the right ear. This is the theory, but it's not what happens in real world recordings.

There are two traditional types of microphones: omnidirectional and unidirectional. An omnidirectional microphone is a pressure transducer. It senses variations in sound pressure. It is very nearly equally sensitive to sounds coming from all directions. The unidirectional microphone is a velocity transducer. It senses the difference in sound pressure as a soundwave passes by. Unidirectional microphones are more sensitive to sounds coming from one direction.

Sound engineers have many options for positioning traditional microphones to make stereo sound recordings. Author Stanley Lipshitz described many of the options in his paper "Stereo Microphone Techniques". In summary, the combination of microphone spacing and directional angles produce variations in the ITD and ILD. The basis for all these stereo recording techniques is Rayleigh's 100-year-old Duplex Theory of Sound Localization. Unfortunately, 50 years of refining traditional stereo microphone techniques have not produced sound recordings that are close enough to realizing the goal of creating a "live experience", so listeners often note that something is missing.

Binaural Recording

Binaural recording methods introduce effects of the human head into the sound recording process. Microphones are inserted into the ears, positioned as close as physically possible to the eardrums. Playback uses headphones that are also inserted into the ears. Since most humans find these intrusions into their ears uncomfortable, binaural recordings are usually made with a dummy head and artificial ears. Author Francis Rumsey summarized recent research in binaural methods in his report titled, "Whose head is it anyway?" In theory, a recording made at the eardrums should contain all the sonic effects caused by a listener's head so the Head Related Transfer Function ("HRTF"), the ILD and the ITD should all be incorporated in a binaural recording together with the effects of the pinnae and the inner ear. When reproduced, the sound at the eardrums should be identical to the original. Unfortunately, the theory doesn't hold up in practice. Listeners perceive flaws.

One flaw perceived in binaural recording playback is the fuzziness of sounds located in front of the listener. These sounds seem distant, while sounds on the left and right seem too close. It's as if the soloist in front of the listener is further away than the surrounding musicians. The phrase "Hole in the Middle" describes this effect. On closer listening one realizes that the sound in front of the listener may not be in front at all. It may be behind the listener. It's not at all like the sound image the listener hears in life. There are several reasons for the difference. Foremost is the lack of visual cues. Our eyes work together with our sense of hearing to help our mind locate sounds. Visual cues tell listeners whether a sound is in front. Listeners also constantly move their heads ever so slightly. By doing so listeners are subconsciously altering the ITD. Our mind senses these microsecond differences in time, processing them like radar to locate sounds precisely. Using this slight head motion, listeners can tell whether a sound is in front, behind and in some cases above the head. A dummy head cannot do this because it is stationary.

Another problem with binaural is the resonances introduced by the ear canal and the pinnae which cause colorations to the sound that are uniquely individual. Listeners each hear their own resonances naturally. However, with binaural the effect is doubled. First the microphone in the dummy head's ear canal embeds the resonances in the recording. Then on playback listeners hear the dummy's resonances added to those of the listeners' own ears. This doubling of resonances produces harshness in mid to high frequency sounds and confuses listeners' minds. The prior art includes efforts to create stereo or binaural recordings using microphones inserted into a live listener's ear canals. For example, FIG. 1C is a drawing taken from U.S. Pat. No. 3,969,583, Griese et al showing an early attempt to make stereo recordings using microphones 27 anchored behind the tragus 24 in the ear canals 22 of a listener 11 by inserting "Mounting projection 32" into the listener's ear canals. For a more modern example, FIG. 1D is a drawing taken from another U.S. Pat. No. 9,967,668, Mattana showing another attempt to make recordings with an earpiece set using "binaural" microphones which are also inserted in the ear E within the ear canal of a user, behind the Tragus T. These approaches have not been widely adopted, possibly because physicians ask their patients not to insert foreign bodies into their ears, or perhaps because of poor comfort or poor audio quality in the resulting recordings.

Listening to binaural recordings on loudspeakers instead of headphones produces a sonic cauldron. The major problem is cross talk. Sound from the left channel that's intended only for the left ear can now be heard by the right ear. Similarly, the right ear hears left channel sound from the left speaker. This mixing together of channels collapses the binaural sound stage. Recent developments in digital processing are improving loudspeaker listening by introducing cross talk cancelling signals. The Jambox™ brand speaker product is a commercial implementation of this technology. The three-dimensional quality of the sound is quite impressive, but only for one listener positioned precisely in front of the speakers.

There is a need, therefore, for an improved method and system for capturing a sound field or the sense actually being present with practical sound recording instruments and methods which address many of the flaws of traditional stereo and binaural microphone techniques.

SUMMARY OF THE INVENTION

In the present invention, improved sensors, systems and methods for capturing a sound field (or the sense actually being present) overcome many of the flaws of traditional stereo and binaural microphone techniques. In the present invention, traditional microphones are replaced with a pair of small acoustic pressure sensors that are carried or worn, preferably by a recording user attending an event. A recording user wears the paired sensors in novel and carefully selected positions which capture sound and the sonic image or sound-field a way which enables playback simulating the way the user hears that sound field, when present. A configuration of paired (preferably spherically shaped) acoustic pressure sensors are incorporated into a system which effectively encodes the Head Related Transfer Function ("HRTF") into an audio recording file while making a recording.

The sound field recording system of the present invention uses paired (i.e., left side and right side) acoustic pressure transducers or sensors, carried by or mounted on opposing sides of the head, attached to left and right side ear hook supports made of a malleable material, so the user/wearer can shape them to fit his or her ears. The paired acoustic pressure transducer assembly, once molded or shaped by the user, is comfortable to wear and visually discrete (meaning others in the vicinity won't likely notice the user is wearing and operating a sound field recording device).

In contrast to the binaural systems of the prior art (which position sensors in the ear canal of a user or stationary dummy head, the paired acoustic pressure transducer assembly of the present invention places sound field recording spherical acoustic pressure sensors or microphones in front of the recording user's ears, in front of the tragus, near or on the recording user's left and right temples. The applicant has discovered that shape of human head and the acoustic shadow is much more uniform (from person to person) in this area, making the HRTF similar for a wide variety of individuals. The applicant's early development work demonstrated that the prior art systems (e.g., as illustrated in FIGS. 1C and 1D) provided poor audio quality in the resulting recordings, because each of these prior art approaches was necessarily adversely affected by the individual listener's external ear anatomy (which can vary significantly from user to user). By moving the new Sonic Sphere sensors of the present invention in front of the ears, the acoustic effects of the ear's pinnae (whose shape differs widely between individuals) is minimized. Moving the sensors forward also reduces the recording angle, which enhances the center image and fills in the sonic soundstage 'hole in the middle' in recordings made with the system and method of the present invention. The hole in the middle is the chronic problem for binaural recording systems, as noted above. The sonic sphere spatial microphone sensors of the present invention are not inserted into the ear canals like binaural microphones, so there is no ear canal resonance or physical discomfort. The user's ears are not blocked, so the user/wearer can enjoy the sound while making a recording.

The design inherent in the sound field recording or capture system (with the paired acoustic pressure transducer assembly) and the method of the present invention capture sound with three-dimensional realism because the applicant has re-examined the effects of the Head Related Transfer Function (HRTF) and its associated time and level differences, which are critical during listening or playback for cueing the mind's auditory perception. Traditional microphones, and the complicated techniques for using them, do not adequately capture the HRTF. The Sonic Presence™ system and method of the present invention replace traditional microphones with the paired spherical sensors which are worn to capture sound the way a listener hears it, essentially encoding the HRTF into a recorded audio file while making a recording.

When the listener listens to a recording captured with the sound field recording system of the present invention, his or her mind detects the embedded spatial cues. The sound image expands outside the listener's head and beyond. Left, right, in front, and behind—the listener hears the full 360-degree soundstage all around. The system's spherical sensors are pressure transducers which transform variations in sound pressure into an electrical signal with two dimensions: pitch and amplitude. The system's pair of sensors encode audio which, when played back, provides a three-dimensional quality of sound which test listeners have indicated is quite impressive. When in use by recording users or wearers (recording an event's sound field), the recording user or wearer fits and then dons the labelled left and right spherical acoustic pressure sensors so they are supported next to the correct designated left and right ears, and so becomes the sound engineer, supporting and aiming the paired sensor array for the duration of the recording session.

The paired spherical acoustic pressure sensors are suspended upon the distal end of elongated flexible members made of a malleable material, so the wearer can readily shape the flexible members to fit over his or her ears. Once fitted, the slip-on design is comfortable to wear, very discrete, shockproof and waterproof, and the paired spherical acoustic pressure sensors plug directly into the wearers mobile device's charging port, for power and to communicate the transduced audio signals from each sensor or transducer.

The sensors, system and method of the present invention provide an economical and effective way to make Virtual Reality ("VR") audio-visual recordings having ambient soundscapes with an aural perspective which is substantially constant and fixed in relation to a contemporaneous video recording. In the method for creating immersive VR recordings of an environment, performance or event of the present invention, the recording user's audio and video recording ("AVR") instrument (e.g., a smartphone such as an iPhone™ or a portable recorder such as a GoPro™ camera) has at least one lens aimed along a lens central axis and has audio signal inputs for a left channel signal and a right channel signal. The recording user employs a spatial microphone audio recording system (with the left spatial microphone sensor configured to be worn in front of the left ear over (and preferably resting against) the left temple and the right spatial microphone sensor in front of the right ear over (and preferably resting against) the right temple). Once the recording user gathers these components, the components are worn, held or mounted (e.g., upon the recording user's body) with the AVR (or smartphone) in an orientation which aligns the AVR's lens central axis toward a target person, place or thing to be recorded (e.g., while the AVR is carried or worn in front of the recording user's chest, aimed forwardly).

Next, the recording user dons the spatial microphone recording system with the labelled left sensor over the left ear and the labelled right sensor over the right ear so that they are (preferably) symmetrically oriented and more or less equally spaced from an imaginary vertical plane bisecting the left and right sides of the recording user or wearer's head. Next, the AVR is oriented and aligned so that the AVR lens central (aiming) axis is very nearly in substantial alignment with the vertical plane bisecting the left and right sides of the wearer's head such that the AVR lens is preferably substantially equidistant from the left spatial microphone sensor and the right spatial microphone sensor. Preferably, the three elements (i.e., left spatial microphone sensor, right spatial microphone sensor and the AVR) are configured in a triangle with the spatial microphone sensors just a bit wider than head-width apart (e.g., 9 inches apart) and the AVR preferably equally spaced from the spatial microphone sensors and in front of the recording user's sternum (perhaps worn in a pocket or hanging from a chain worn around the neck) or chin (when handheld, in front of the face), so the AVR is preferably about 10-14 inches away from each spatial microphone sensor.

At the moment the recording user initiates a VR recording or begins a VR recording of an environment (e.g., a performance, event, target person, place or thing), the recording user maintains the triangle configuration as constantly as possible for the duration of the VR recording. It is important that for the selected duration of the VR recording, the recording user (or, alternatively, a fixture) maintains the relative positions of the AVR lens central axis to the left spatial microphone sensor and the right spatial microphone sensor such that there is substantially no change in the direction or distances between the AVR lens, the AVR lens central axis, the distance from the AVR lens to the left spatial microphone sensor and the distance from the AVR lens to the right spatial microphone sensor. This configuration, if substantially maintained, provides a VR recording which has, for the entire duration of the recording, a substantially constant and fixed aural perspective which an audience member viewing and hearing the VR recording will recognize as placing seen objects in a sound-field such that (a) moving objects in the VR recording's image are aurally tracked in the VR recording's audio playback and (b) moving (e.g., panning right) perspectives seen in the VR recording's image are continuously aurally tracked in the VR recording's audio playback (e.g., so something audible which was seen as straight ahead initially, upon panning right is heard moving continuously into the audience member's left ear's hearing and away from the right ear).

Applicant's development work with the system and method of the present invention has revealed that these VR recordings, upon playback, provide the substantially constant and fixed aural perspective which audience members recognize as placing seen objects in an immersive soundfield such that moving objects in the VR recording's image are aurally tracked in the VR recording's audio playback when the objects move out of the visual frame. Those objects, now heard but not seen, move into an imagined space which is to the left, or to the right, or overhead or behind the audience member so that the audience member experiences a substantially continuous immersive VR audio-video playback experience.

The above and still further features and advantages of the present invention will become apparent upon consideration of the following detailed description of a specific embodiment thereof, particularly when taken in conjunction with the accompanying drawings, wherein like reference numerals in the various figures are utilized to designate like components.

DESCRIPTION OF THE PREFERRED EMBODIMENT

Turning now to FIGS. 2-13B, the sound field recording system of the present invention 100 includes a recording user or wearer configurable paired spherical acoustic pressure sensor assembly 120 which has been configured to capture and record audio signals with significantly improved spatial fidelity and which, upon playback through headphones, earbuds or other playback transducers provides an enhanced and more immersive listener experience.

Figure 2:
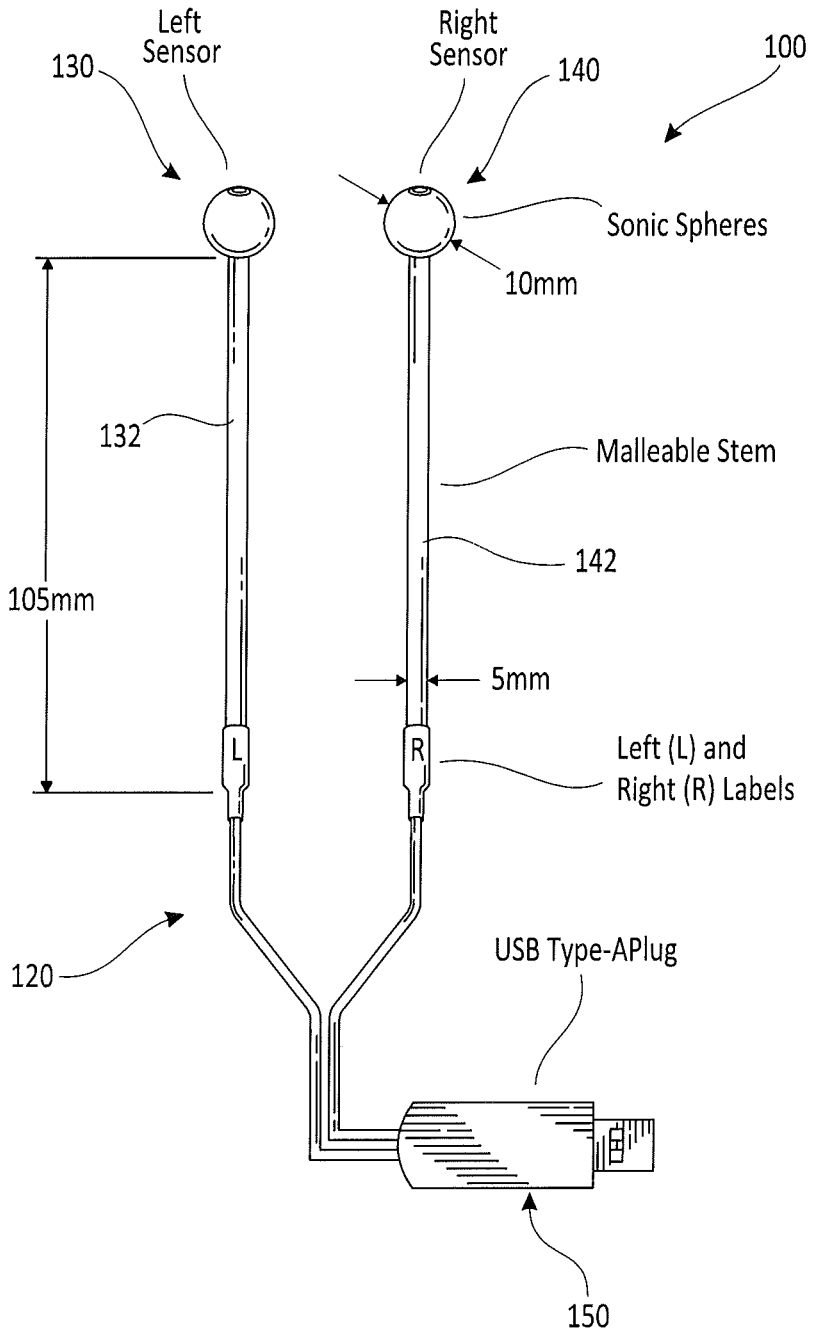
FIG. 2 is a diagram illustrating the features of the paired spherical acoustic pressure sensor assembly of the sound field recording system of the present invention, illustrating the first and second (i.e., left and right) pressure transducers as configured on supporting flexible ear-hook defining members made of a malleable material and encasing the audio cable's signal conducting wires which are also connected to a USB plug assembly, in accordance with the present invention.
Figures 3A, 3B:
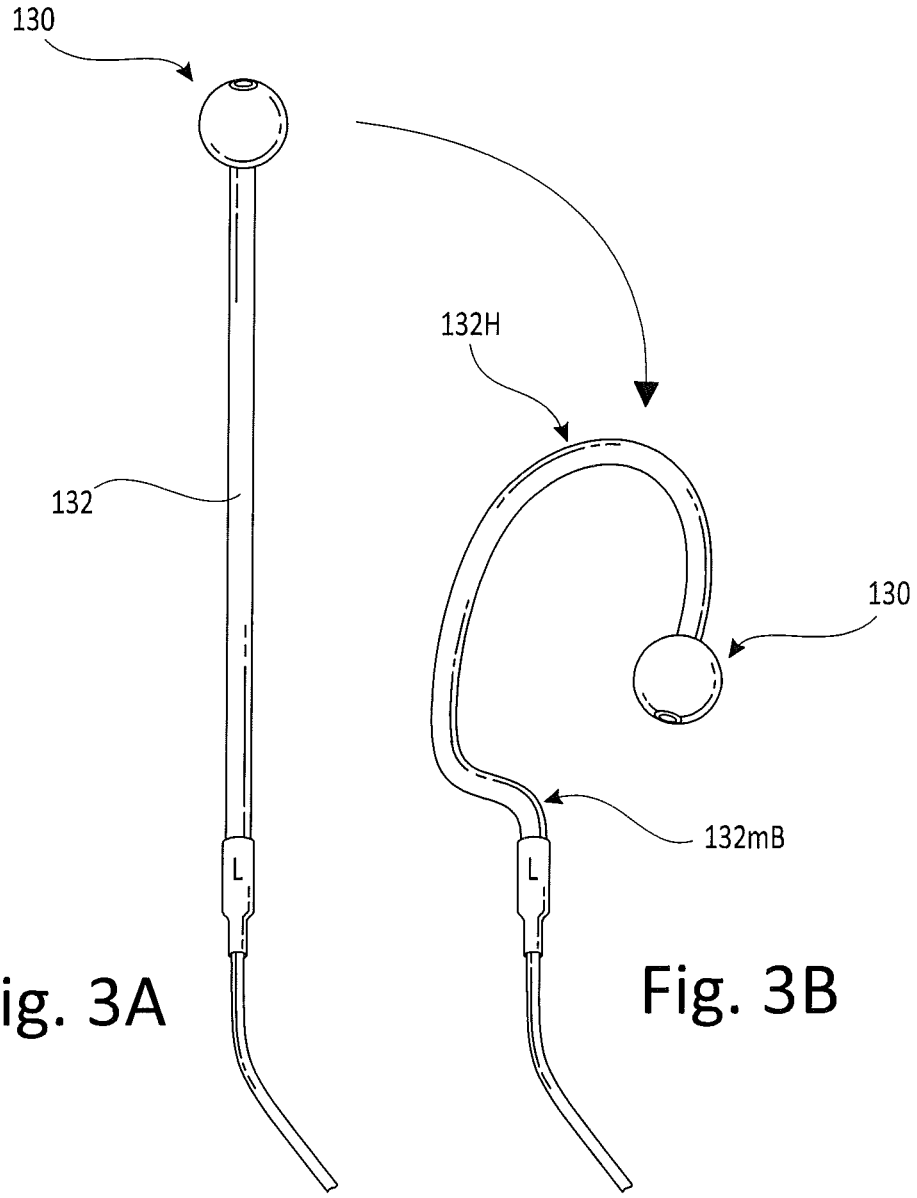
FIGS. 3A and 3B are diagrams illustrating how the spherical acoustic pressure sensor assembly of FIG. 2 is modified or customized by the user when the (e.g.) right pressure transducer supporting member is fitted or contoured to be comfortable when carried over the wearer's ear on the right side of the head with the flexible ear hook defining member shaped to fit his or her ear, in accordance with the present invention.
Figure 4:
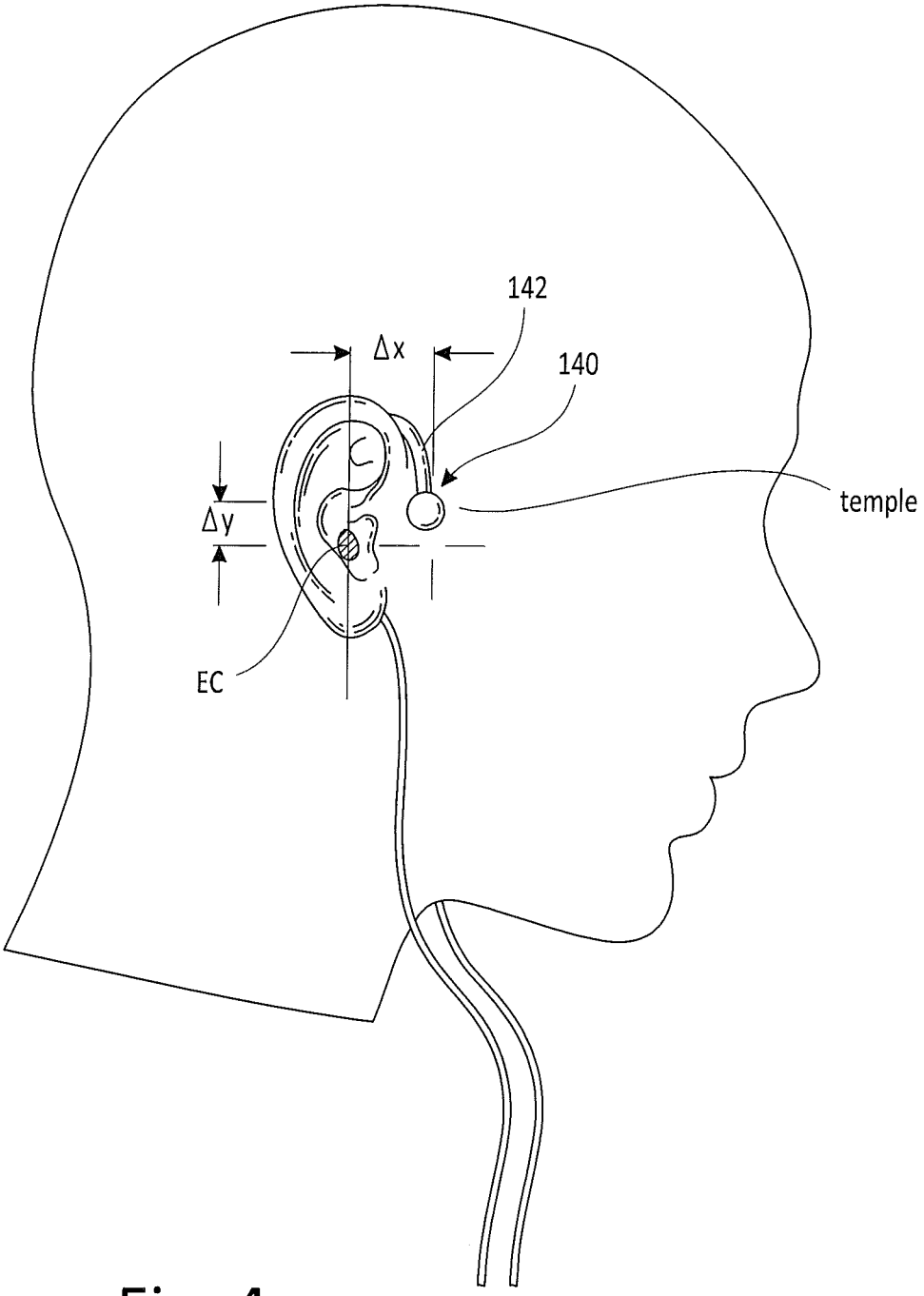
FIG. 4 is a diagram illustrating how the spherical acoustic pressure sensor assembly of FIGS. 2 and 3B is worn by the user when the (e.g.) right pressure transducer is carried over the wearer's ear on the right side of the head, in accordance with the present invention.

Referring initially to FIGS. 2-4, in accordance with the present invention, an improved method and system 100 for capturing a sound field (or the sense actually being present) addresses many of the flaws of traditional stereo and binaural microphone techniques discussed above. In the paired acoustic pressure transducer assembly 120, traditional microphones are replaced with a pair of spherical acoustic pressure sensors (e.g., 130, 140) carried on the body in a new way. When recording, the user wears the paired sensors (e.g., 130, 140) suspended from cable temple defining ear hook members carried over the left and right ears (as shown in FIG. 4) in selected positions just in front of the ear canal to capture sound and the sonic image or sound-field a way which enables playback simulating the way that user hears that sound field, when present for the recorded event. The configuration of paired spherical acoustic pressure sensors (e.g., 130, 140) in system 100 effectively encodes the Head Related Transfer Function ("HRTF") into the recording (e.g., the recorded data file) while making a recording.

Sound field recording system 100 is configured for attachment to a portable device such as a smartphone or mobile device (e.g., an Apple® iPhone® not shown) using a USB interface or another standardized interface or connector. The system's paired spherical acoustic pressure sensor assembly (e.g., 120 or 220) uses first and second acoustic pressure transducers or sensors which are comfortably worn over the left and right ears on opposing sides of the head, attached to left and right side cable temple defining ear hook members (e.g., 132, 142) made of a malleable material, so the user/wearer can shape them to fit his or her ears. They are comfortable to wear and visually discrete. People in the vicinity of a wearer recording an event won't likely notice them. In contrast to the binaural systems of the prior art (e.g., Mattana's earpiece set in U.S. Pat. No. 9,967,668) which position sensors in the ear, the present invention places sound field recording spherical acoustic pressure sensors or microphones in front of the ears, near the temples.

The shape of human head (see FIGS. 4 and 6) is much more uniform from person to person in this anatomical area, making the Head shadow or HRTF more similar for different individuals. By moving the sensors in front of the ears, the sonic effects of the pinnae (whose shape differs widely between individuals) is minimized. Moving the sensors forward also reduces the recording angle, which enhances the center image and fills in the sonic soundstage hole in the middle. The hole in the middle is a chronic problem for binaural recording systems. Importantly, the spatial microphone sensors are not inserted into the ears as with binaural systems and methods, so there is no ear canal resonance or physical discomfort. The user's ears are not blocked, so the user/wearer can enjoy the sound while making a recording.

Figure 11A:
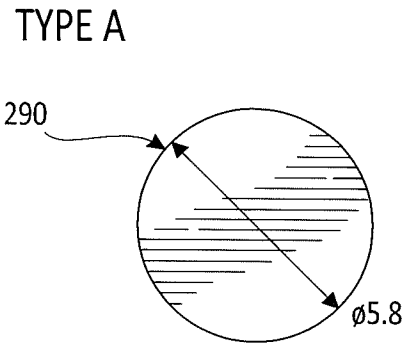
FIGS. 11A, 11B, and 11C, are views illustrating a first microphone element, acoustic transducer or sensor element suitable for incorporation into the paired acoustic pressure transducer assembly of the present invention.
Figure 11B:
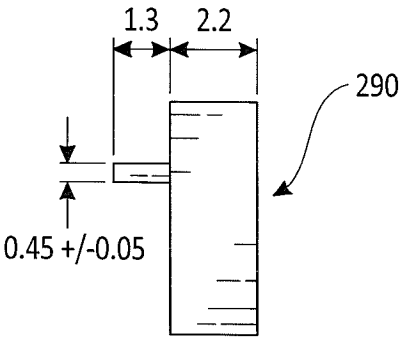
Figure 11C:
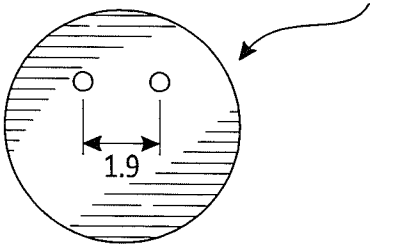
Figure 11D:
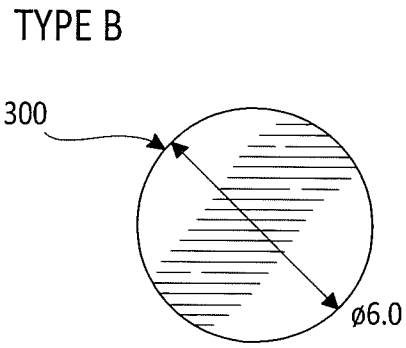
FIGS. 11D, 11E and 11F are views illustrating a second microphone element, acoustic transducer or sensor element suitable for incorporation into the paired acoustic pressure transducer assembly of the present invention.
Figure 11E:
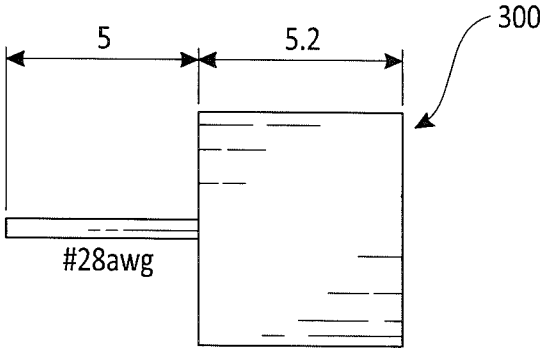
Figure 11F:
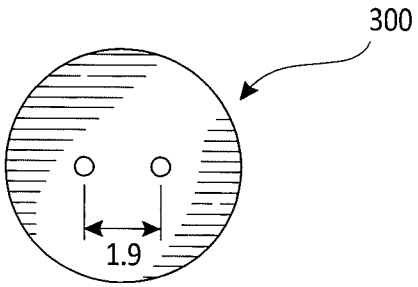
Figure 11H:
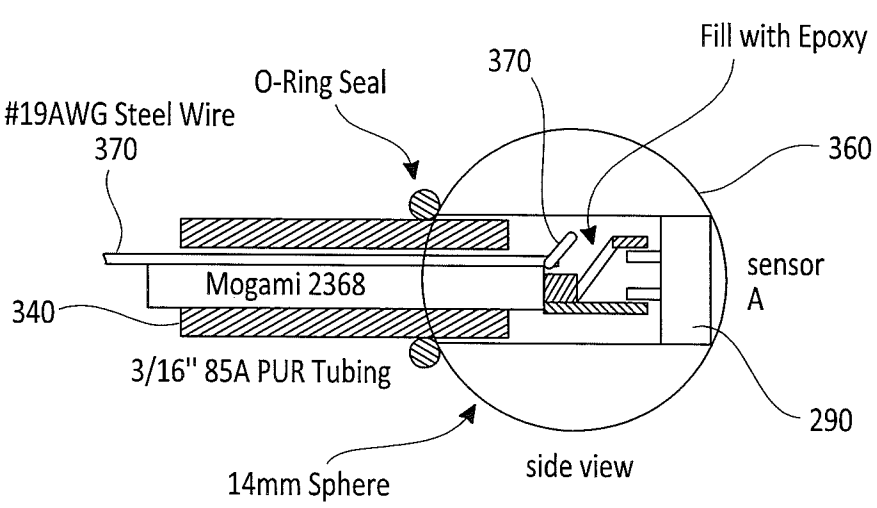
FIGS. 11G and 11H are proximal end view and cross section side view diagrams illustrating the components assembled with the sensor of FIGS. 11A, 11B and 11C in the paired acoustic pressure transducer assembly of the present invention.
Figure 11G:
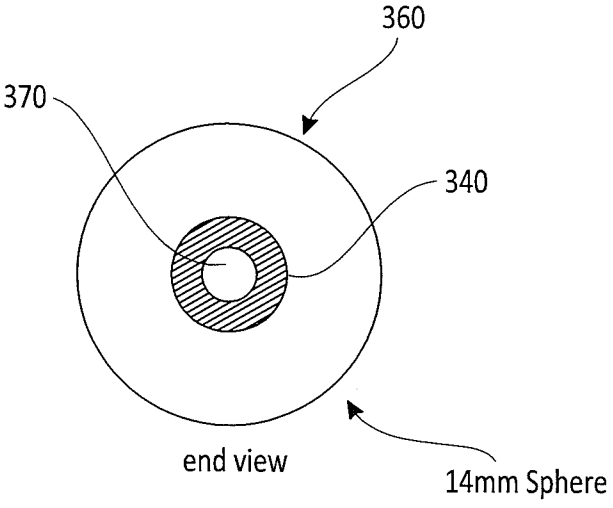
Figure 11I:
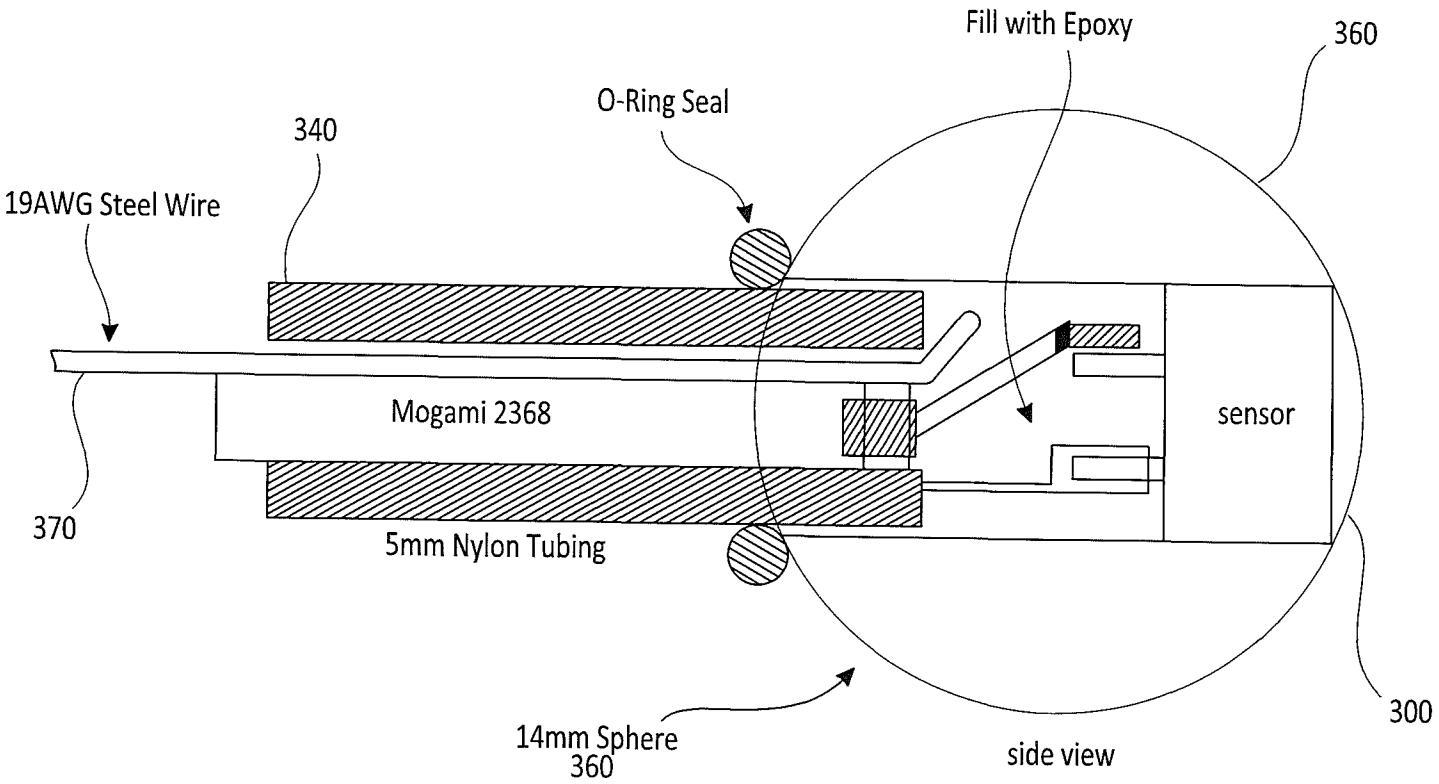
FIG. 11I is a diagram illustrating a cross sectional view of the components assembled with the sensor of FIGS. 11D, 11E and 11F in the paired acoustic pressure transducer assembly of the present invention.

The paired acoustic pressure transducer assembly (e.g., 120 or 220) employs very compact structures which support, aim and carry very compact substantially omnidirectional microphone sensor or transducer elements (e.g., 300, as seen in FIGS. 11E and 11I which illustrate microphone element or acoustic transducer or sensor element 300 which is suitable for incorporation into the paired acoustic pressure transducer assembly of the present invention. In a promising prototype, transducer 300 is a prepolarized electret microphone transducer with very flat frequency response, having a cylindrical body of with a cylinder circumference of 6 mm or about 0.25 inches in diameter, with first and second electrically conductive leads extending proximally from a back end, as seen in FIGS. 11E and 11I. Sensor 300 preferably has s sensitivity of −48 db (+ or −3 dB), a standard operating voltage of 2 Vdc, a max operating voltage of 10 Vdca max current consumption of 0.5 mA, an impedance of 2.2 KOhm, and in use provides a signal to noise ration of 60 dB. Sensor or transducer element 300 is readily mounted within a hollow or tubular structure defining a lumen open on both ends, preferably shaped as a small sphere (e.g., 360) having an outside diameter of 10-14 mm and made of a tough, resilient, non-resonant material such as Delrin™ or a similar plastic material which provides good dimensional stability, low (or no) moisture absorption, high fatigue endurance, high strength and stiffness properties, good impact and creep resistance, chemical resistance to sweat or solvents, and, for contact with a user's skin, the material is preferably FDA, NSF and USDA compliant.

Turning to FIGS. 11A-11C, three views of a first prototype microphone sensor 290 are illustrated. Compact substantially omnidirectional microphone sensor or transducer element 290 is also a prepolarized electret microphone transducer with very flat frequency response, having a cylindrical body of with a cylinder circumference of 5.8 mm or about 0.24 inches in diameter, with first and second electrically conductive leads extending proximally from a proximal or back end (as seen in FIGS. 11B and 11H) and a substantially circular distal sensing end (as seen in FIG. 11A). During assembly (which is described in more detail below) a coaxial cable (e.g., Mogami model 2368) is inserted into the central open lumen of a segment 340 of Polyurethane tubing (e.g., PUR type 85A) of 5 mm or 3/16 inch diameter after being soldered or electrically connected to sensor 290 (as shown in FIG. 11H) and then the 10-14 mm nylon sphere shaped member 360 having an open lumen therethrough is placed over the sensor assembly with the sensor's operative, sensing surface proximate the distal opening in the spherical body member (as seen in FIG. 11H) so that the sensing surface of sensor 290 is in fluid communication with the ambient environment. In order to make the malleable cable temple defining ear hook member hold its shape after being bent into a desired contour, a slender but ductile and tough (e.g., 19 gauge steel) wire segment 370 is also inserted into and held within the lumen of the PUR tubing segment 340.

Turning next to FIGS. 11D-11F, three views of another prototype microphone sensor 300 are illustrated. As noted above, compact substantially omnidirectional microphone sensor or transducer element 300 is a prepolarized electret microphone transducer with very flat frequency response, having a cylindrical body of with a cylinder circumference of 6.0 mm or about 0.25 inches in diameter, with first and second electrically conductive leads extending proximally from a proximal or back end (as seen in FIGS. 11E and 11I) and the substantially circular distal sensing end (as seen in FIG. 11D). During assembly (also described in more detail below) a coaxial cable (e.g., Mogami model 2368) is inserted into the central open lumen of a segment 340 of Polyurethane tubing (e.g., PUR type 85A) of 3/16 inch diameter after being soldered or electrically connected to sensor 300 (as shown in FIG. 11H) and then a 10-14 mm nylon sphere shaped member having an open lumen therethrough is placed over the sensor assembly with the sensor's operative, sensing surface proximate the distal opening in the spherical body member (as seen in FIG. 11I) so that the sensing surface of sensor 300 is in fluid communication with the ambient environment. In order to make the malleable cable temple defining ear hook member hold its shape after being bent into a desired contour, a slender but ductile and tough (e.g., 19 gauge steel) wire segment 370 is also inserted into and held within the lumen of the PUR tubing segment 340.

Figure 12A:
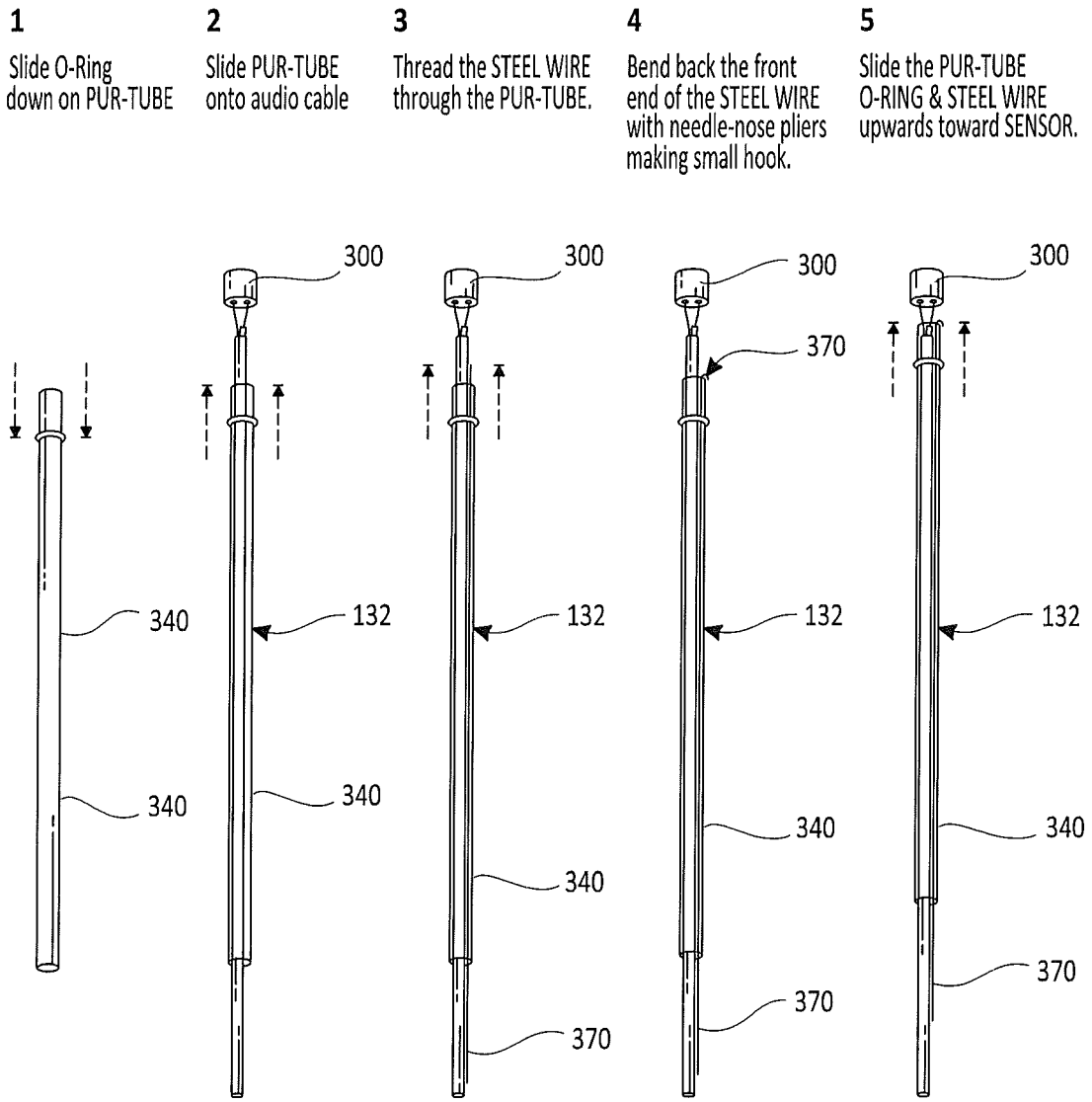
FIG. 12A illustrates the first 5 steps in the assembly method for the paired acoustic pressure transducer assembly incorporating the sensor of FIGS. 11E and 11H, in accordance with the present invention.
Figure 12B:
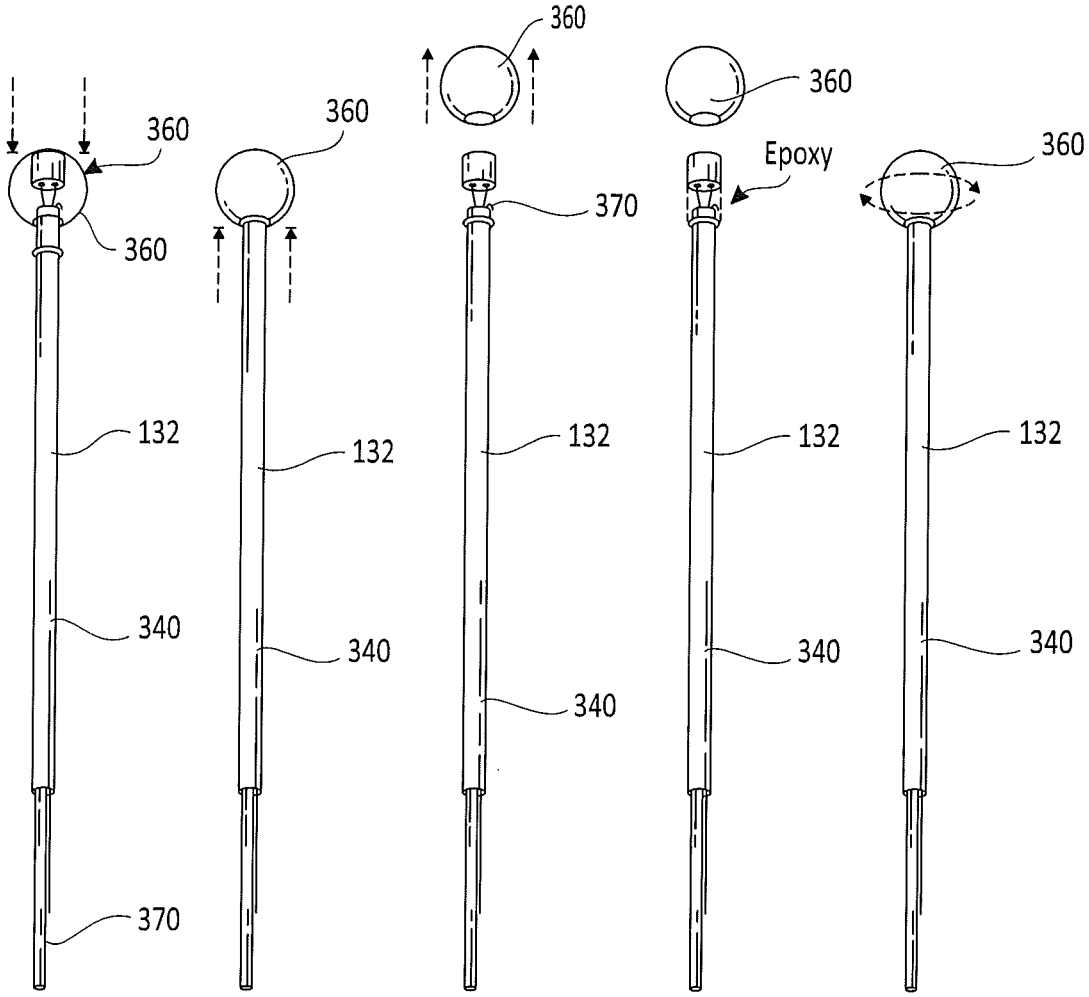
FIG. 12B illustrates steps 6-10 in the assembly method of FIG. 12A for the paired acoustic pressure transducer assembly incorporating the sensor of FIGS. 11E and 11H, in accordance with the present invention.
Figure 12C:
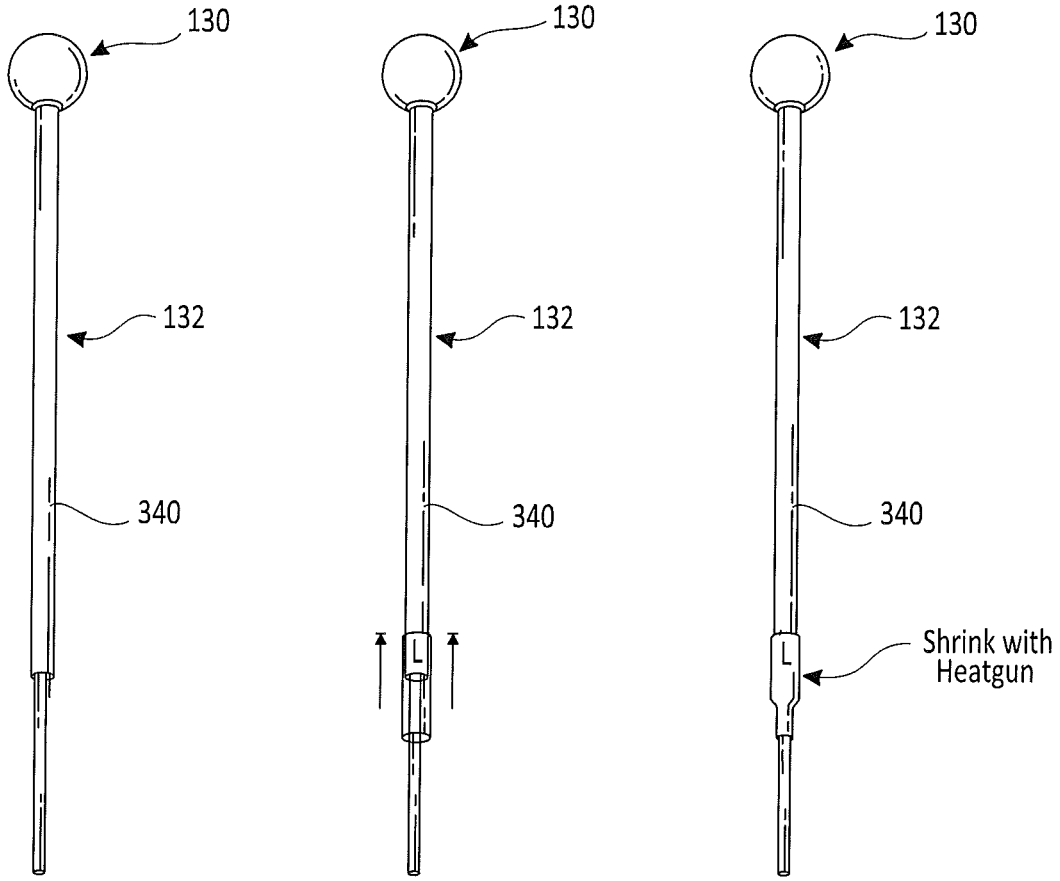
FIG. 12C illustrates steps 11-13 in the assembly method of FIGS. 12A and 12B for the paired acoustic pressure transducer assembly incorporating the sensor of FIGS. 11E and 11H, in accordance with the present invention.
Figure 12D:
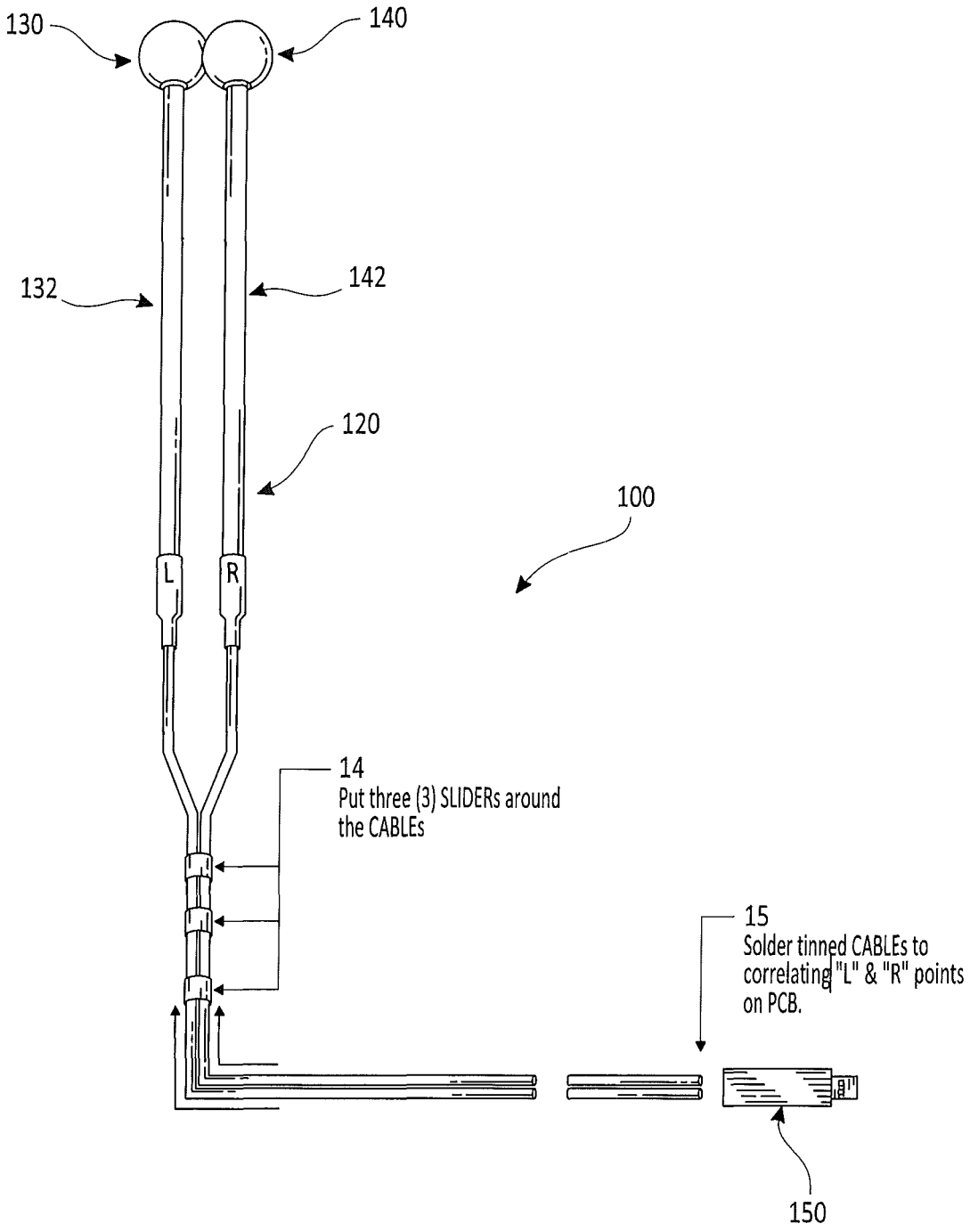
FIG. 12D illustrates steps 14 and 15 in the assembly method of FIGS. 12A-12C for the paired acoustic pressure transducer assembly 100 incorporating the sensor of FIGS. 11E and 11H, in accordance with the present invention.

In testing prototypes of paired acoustic pressure transducer assembly (e.g., 120 or 220), the applicant discovered that only certain transducers would provide the comfort and audio fidelity required and that the assembly method required certain elements to be selected and assembled in a specific manner. Turning next to FIGS. 12A-12D, the method for assembling the paired acoustic pressure transducer assembly (e.g., 100 incorporating the sensor of FIGS. 11E and 11H) begins with cutting or providing a segment 340 of Polyurethane tubing (e.g., PUR type 85A) of 5 mm or 3/16 inch diameter and having a length of 105-120 mm and then placing a polymer O-ring member over the distal end, as shown for Step 1. Next, the polyurethane tubing segment is placed over the audio coax-cable and sensor assembly with sensor 300 left projecting from the tube segments open distal end. In step 3, the ductile and tough (e.g., 19 gauge steel) wire segment is inserted into the tube's lumen (step 3) the distal end of the steel wire segment is bent back to provide (or initially provided with) a small distal hook-shaped contour (step 4) and the O-ring is then slidably moved proximate the wire hook (step 5). In step 6, the central axial lumen of spherical body member 360 is slid onto the sensor until the sensing end of sensor 300 is flush with the sphere lumen's distal opening (step 6) whereupon the O-rings member may be pushed into the sphere's proximal side or base (step 7). In steps 8-10, the sphere is removed, epoxy is applied over the outer surfaces of the sensor and audio cable assembly and then sphere 360 is carefully replaced and rotated to distribute the epoxy and make the sensor assembly (e.g., 130) a substantially solid void-free sonic sphere omni-directional pressure sensor. Steps 11-15, as illustrated in FIGS. 12C and 12D, includes cutting the proximal end of the steel support wire, attaching a labelled shrink wrap segment and shrinking the tubing onto the proximal end to define the malleable cable temple defining ear hook member (e.g., 132). The same steps are used to assemble each sensor in the sensor pair.

Figure 6:
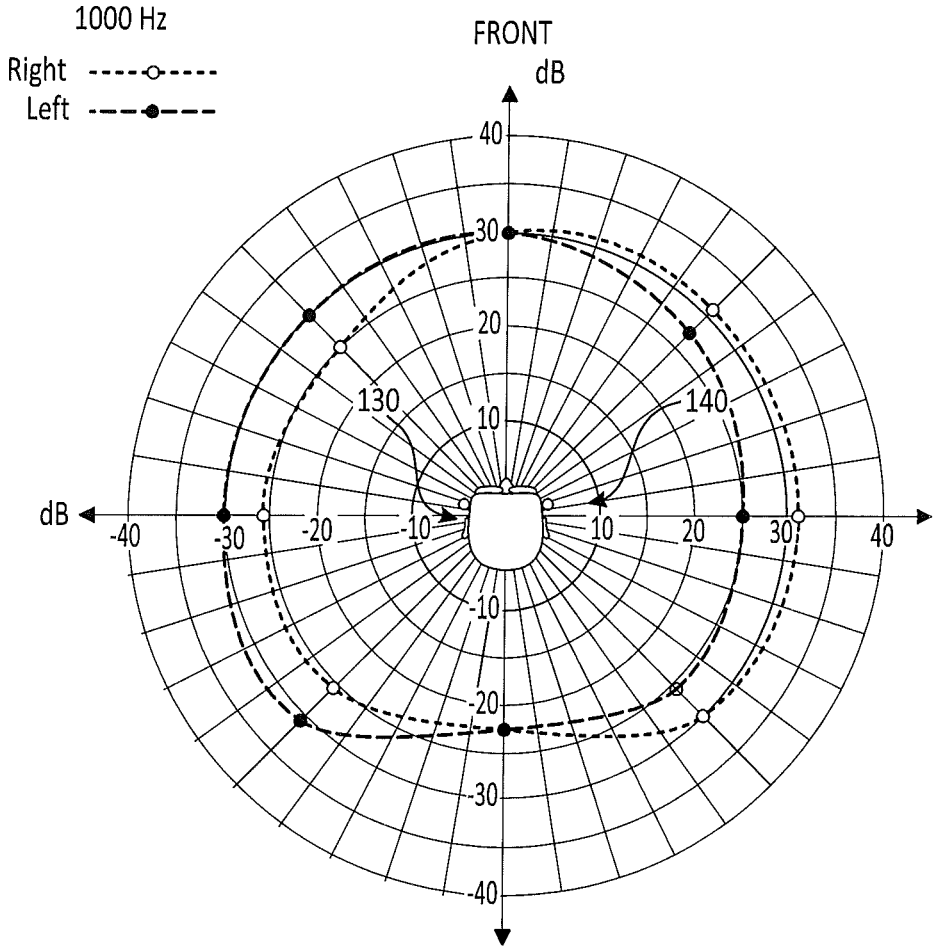
FIG. 6 is an overhead or plan view including (at the center) a recording user or wearer's head with a Polar plot showing the directional characteristics of the left and right paired sonic sphere transducers (of FIGS. 2-4) when worn on the left and right sides of the head. This plot at 1,000 Hz shows distinct cardioid patterns pointing left and right with a 6 dB difference in sensitivity front to back. The left transducer pattern (dash-dot-dash line) and the right transducer pattern (dotted line) indicate the differing directionalities of the left and right side sensors, when worn and used in accordance with the method of the present invention.
Figure 13A:
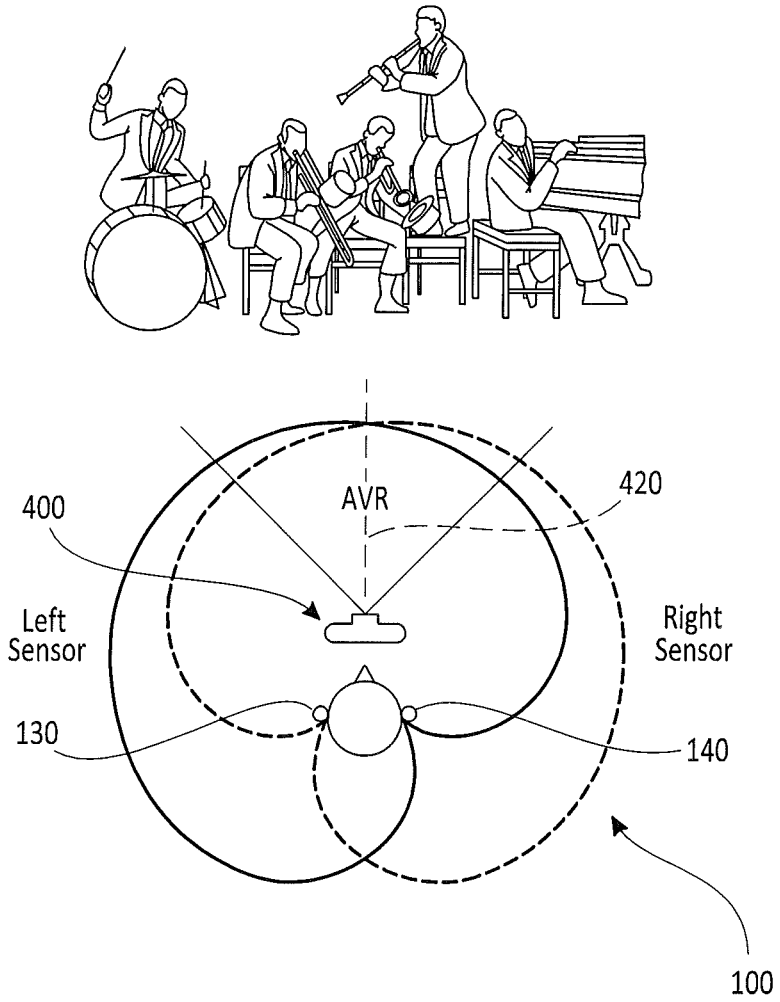
FIGS. 13A and 13B are diagrams illustrating the system and method for making Virtual Reality ("VR") audio-visual recordings having ambient soundscapes with an aural perspective which is substantially constant and fixed in relation to a contemporaneous video recording.
Figure 13B:
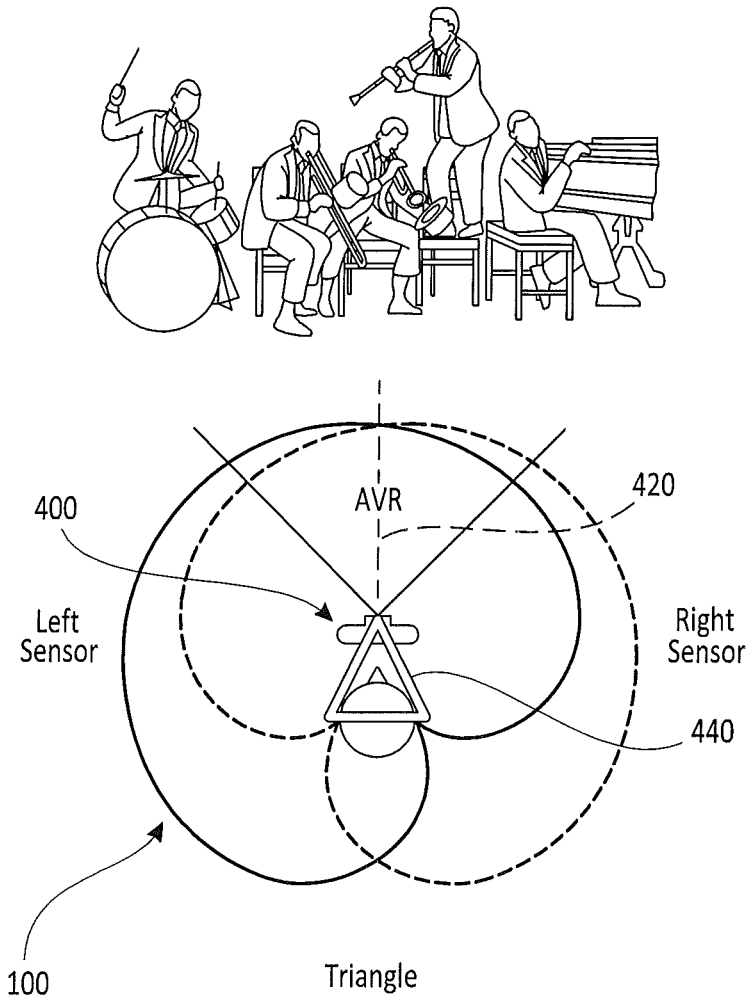

The assembly method of FIGS. 12A-12D is substantially the same for making either embodiment of the paired acoustic pressure transducer assemblies described above (e.g., 120 or 220), with either microphone sensor 290 or 300. In every embodiment the sensor's substantially circular distal sensing end (as seen in FIGS. 11A and 11D) are exposed from the distal open lumen end of the spherical member 360 which, in use, is held next to but spaced from the recording user's temple in a solid void-free structure which provides substantially omnidirectional pressure sensing, whereby all of the "directionality" for each sensor comes from the head shadow of the recording user (as illustrated in FIGS. 6, 13A and 13B).

Sound field recording or capture system 100 when installed using the method of the present invention has been demonstrated to provide a surprisingly uniform (person-to-person) ability to render the effect of a Head Related Transfer Function (HRTF) and its associated time and level differences which are critical for cueing listener's mind's auditory perception. System 100 and the method of the present invention replace traditional microphones with first and second substantially void-free sonic spheres or spherical sensors (e.g., 130, 140) which are worn in front of the ear canal (e.g., preferably 12-30 mm in front of the ear canal, and in front of the tragus) to capture sound the way a listener hears it, essentially encoding the HRTF into a recorded audio file while making a recording. In the example of FIG. 4, the user preferably contours and dons the first and second sensors (130, 140) symmetrically, with the right side cable temple defining ear hook member 142 contoured to fit the recording user's right ear. So the recording user thereby suspends the second or right side pressure sensor or microphone assembly sonic sphere member 140 against or near the user's right temple at a selected distance Delta X (e.g., 12-30 mm) in front of the central axis of the user's right ear canal ("EC") and preferably a selected distance Delta Y above the ear canal on the right side of the user's head (as shown in FIG. 4). Delta Y is preferably 5-20 mm above the central axis of the Ear Canal but could be level with or slightly below the ear canal.

When the listener listens to a recording captured with the sound field recording system 100 of the present invention, his or her mind detects the embedded spatial cues. The sound image expands outside the listener's head and beyond. Left, right, in front, and behind—the listener hears the full 360-degree soundstage all around. The system's spherical sensors or transducers 130, 140 are pressure transducers or substantially omnidirectional microphones which transform variations in sound pressure into an electrical signal with two dimensions: pitch and amplitude (meaning all directionality for each sensor comes from the recording user's head shadow (as shown in FIG. 6). The sound field recording system 100 includes paired transducer assembly 120 with left spatial microphone sensor 130 and right spatial microphone sensor 140 which, when in use, encode audio that upon playback, provides a three-dimensional quality of sound which test listeners have indicated is quite impressive.

When in use by recording users or wearers (recording an event's sound field), the user or wearer fits and dons the paired spherical acoustic pressure sensors 130, 140 on his or her left and right ears (e.g., as shown in FIG. 4), and so becomes the sound engineer responsible for supporting, carrying and aiming sound field recording system 100. The paired acoustic pressure transducer assembly's spherical acoustic pressure sensors (e.g., 130, 140) are suspended at the end of elongated flexible cable temple defining ear hook members (e.g., 132, 142) made of a malleable material, so the wearer can readily shape the flexible members to fit over his or her ears. Referring to FIGS. 1A, 1B, 3B, 4 and 6, each cable temple defining ear hook member (e.g., 132, 142)

defines a Cable Temple member or an earpiece made of metal, plastic, or combination thereof, with the portion in contact with the user's ear consisting of wound wire, with or without a core, preferably containing a two conductor cable connected to the sensor. Each cable temple defining ear hook member is preferably initially straight (as shown in FIGS. 2 and 3A) and malleable and, before use, is typically bent in the shape of a semicircle to become a cable temple support (e.g., 132H) contoured to fit securely around the ear, between the skull and the pinna, as with cable temple eyeglass frame members. The user can also fit each cable temple defining ear hook member (e.g., 132H) to match the contour of the user's skull by defining a Mastoid Bend contour 132 MB at the proximal end of the malleable segment (The curvature in the down bend of the cable temple (earpiece) adapting to the mastoid curvature (depression) beyond the ear.

Once fitted, the slip-on design is comfortable to wear, very discrete, shockproof and waterproof, and the paired pair of spherical acoustic pressure sensors (e.g., 130, 140) are configured with interface circuitry to plug directly into the wearers mobile device's charging port for power and to communicate the transduced audio signals from each sensor or transducer.

Theory of Operation and New Method:

Research in the field of cognitive psychology suggests the Head Related Transfer Function (HRTF) and its associated time and level differences are critical for cueing our mind's auditory perception. Yet this function is mostly absent in today's sound recordings. Traditional microphones, and the complicated techniques for using them, do not adequately capture the HRTF. System 100 and method of the present invention replaces the prior art stereo microphones with paired transducer assembly 120 having left and right side malleable cable temple defining ear hook members 132, 142 carrying left spatial microphone sensor 130 and right spatial microphone sensor 140, which, along with a recoding instrument (e.g., such as a smartphone) provides a small, highly sensitive device that the recording user wears. When in use, sound field recording system 100 embeds the HRTF into an audio recording file while the user makes the recording. Recordings made using the method of the present invention are referred to as Sonic Presence™ audio recording files.

When one listens to a Sonic Presence™ recording made with sound field recording system 100, the listener's mind detects the embedded spatial cues. The sound image expands outside the listener's head and beyond. Left, right, in front, and behind—the listener hears the full 360-degree soundstage all around. Sonic Presence™ recordings made with sound field recording system 100 capture these spatial cues the way the listener's mind has evolved to process them. Instead of trying to create an audio image with an App, the Sonic Presence™ paired spherical acoustic pressure sensor assembly 120 captures sound with the embedded spatial cues that let the listener's mind create the audio image.

Figure 1A:
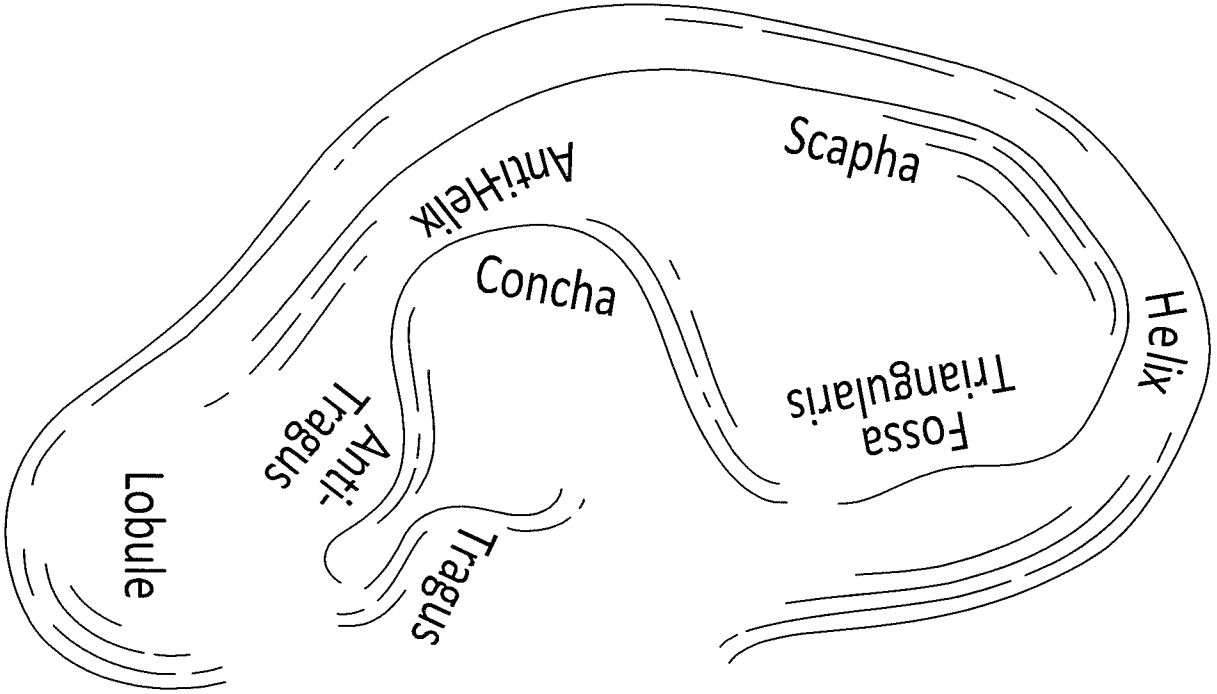
FIG. 1A is a diagram excerpt from Gray's Anatomy showing the anatomical features of the outer ear including the Pinna's Helix and Scapha, in accordance with the Prior Art.
Figure 1B:
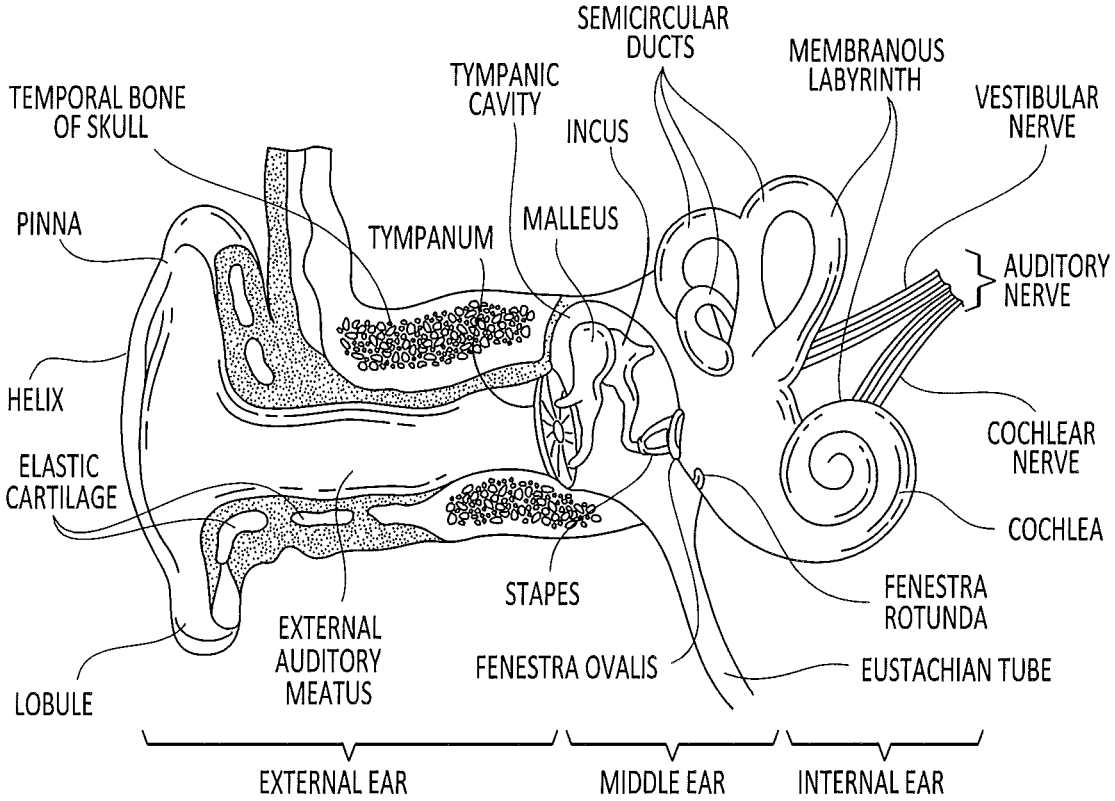
FIG. 1B is a diagram excerpt showing the anatomical features of the outer (external) ear, the middle ear (including the ear canal or external auditory meatus) and the internal ear, in accordance with the Prior Art.
Figure 1C:
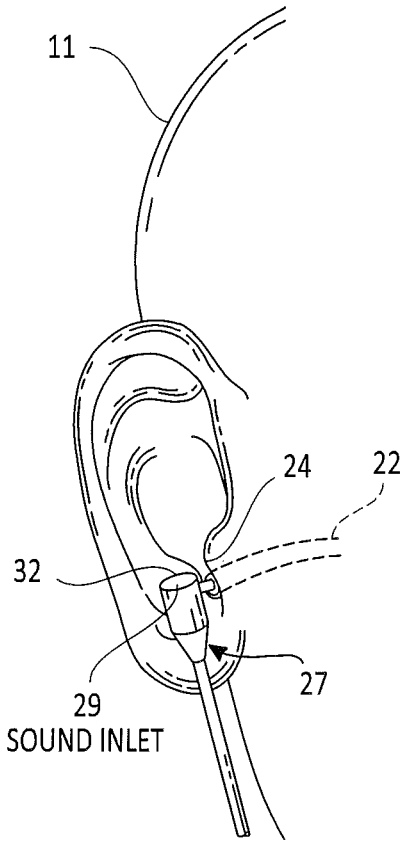
FIG. 1C is a drawing taken from U.S. Pat. No. 3,969,583, Griese et al showing an early attempt to make stereo recordings using microphones anchored in the ear canals of a listener by inserting "Mounting projection 32" in the listener's ear canals, in accordance with the prior art.
Figure 1D:
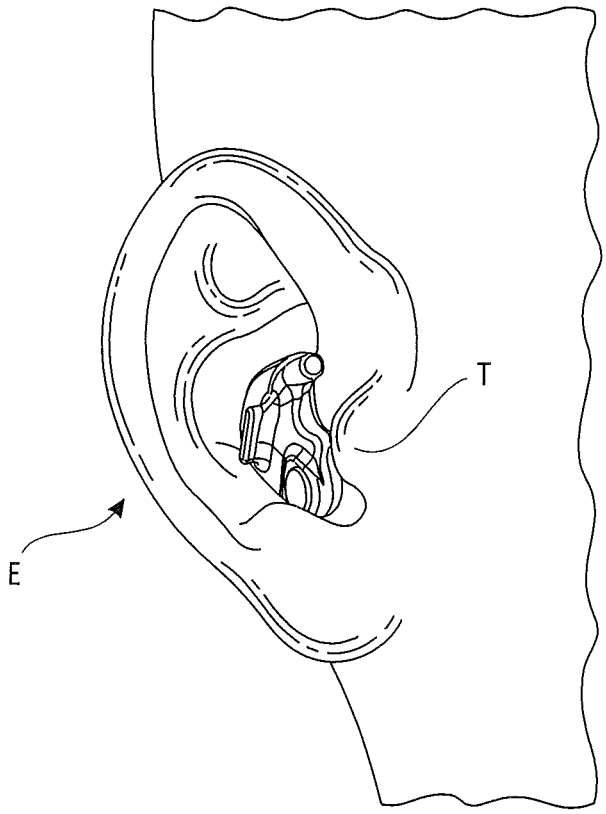
FIG. 1D is a drawing taken from another U.S. Pat. No. 9,967,668, Mattana showing another attempt to make recordings with an earpiece set using "binaural" microphones inserted within the ear canals of a user, in accordance with the prior art.
Figure 1E:
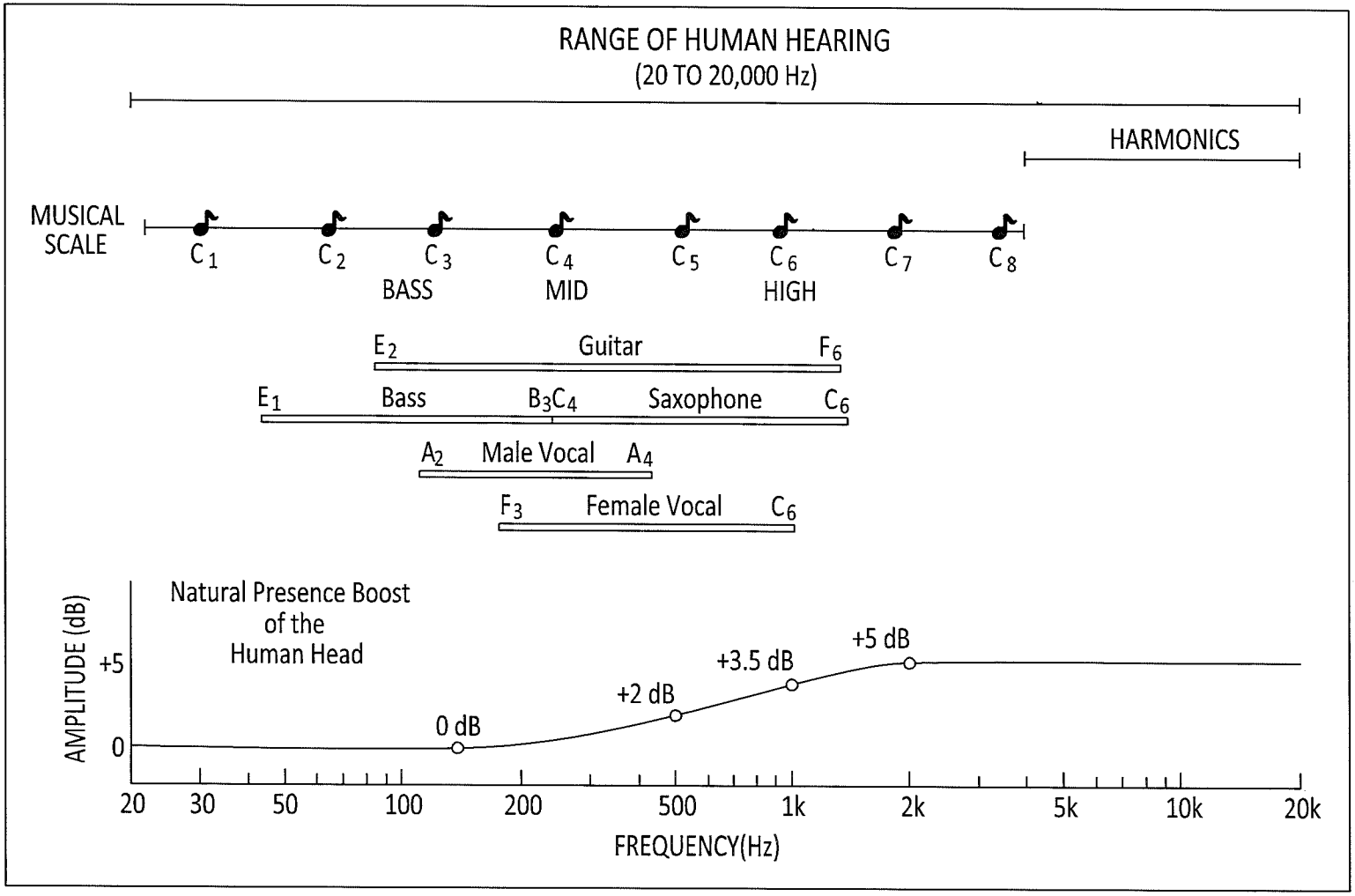
FIG. 1E is a graphical representation of the range (frequency response) of human hearing, illustrating the Natural Presence Boost of the Human Head which begins at a frequency close to Middle C in the center of the male vocal range, reaching its maximum at around $C_7$ (2,093 Hz) just above the highest note of the soprano voice. Musically, the notes in this three-octave vocal range are the most important ones for melody.
Figure 5:
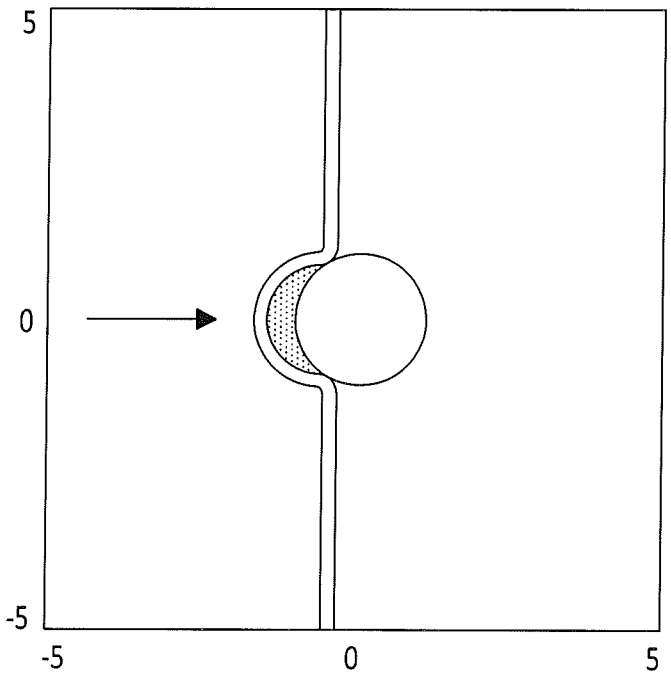
FIG. 5 is a diagram illustrating an incident or direct sound wave colliding with a sphere (as implemented in the pair of spherical acoustic pressure sensors of FIGS. 2-4) to create a pressure zone called a "bright spot" with a buildup in sound pressure at the bright spot caused by the rigid surface of the sphere reflecting the sound wave back onto itself, in accordance with the present invention.

The spherical acoustic pressure sensors (e.g., 130 and 140) transform variations in sound pressure into an electrical signal with two dimensions: pitch and amplitude. These are the same two dimensions the listener hears with one ear. Referring now to FIGS. 5 and 6 (and recalling FIG. 1E), for humans, sensitivity to pitch covers a range of 10 octaves starting at a frequency of 20 Hz in the low bass and extending to 20,000 Hz in the upper harmonics. Human auditory sensitivity to amplitude exceeds a range of 100,000 to 1. FIG. 5 illustrates the sound wave pressure equalizing effect caused by encapsulating each transducer or pressure sensor (e.g., 130, 140) in a spherical housing to provide a sonic sphere. An incident or direct sound wave (e.g., from the left, as seen in FIG. 5) colliding with a sphere (e.g., a 10-14 mm sphere made of Delrin™ or a similar dense non-resonant material, defining a lumen therethrough with opposing open ends, as implemented in the pair of spherical acoustic pressure sensors of FIGS. 2-4) creates a pressure zone called a "bright spot" with a buildup in sound pressure at the bright spot caused by the rigid surface of the sphere reflecting the sound wave back onto itself, and this mechanism makes the transducers (e.g., 130, 140) substantially equally sensitive to sound coming from any direction. The spherical enclosure also provides a comfortable acoustically inert structure which defines a standoff distance between the center of the spherical housing and the surface which may rest against the user's temple, when worn and used.

In the exemplary embodiment, each of the pressure sensors 130, 140 comprises a miniaturized solid state transducer (e.g., pre-polarized electret mic 300 connected via Mogami™ model 2368 unbalanced cable) affixed within a substantially rigid and solid housing member (e.g., a short segment of 5 mm nylon or carbon tube (not shown) which is optionally enclosed within a 10-14 mm sphere (e.g., 360) made of Delrin™ Nylon or a similar dense non-resonant material, defining a lumen therethrough with opposing open ends); and When sound field recording system 100 is connected to a modern digital mobile device (e.g., a smartphone carried in a shirt pocket), sound field recording system 100 accurately captures sounds over this full range of human hearing. As discussed above, human hearing senses more about sounds than just the pitch and amplitude, making it possible for listeners to locate sounds in three-dimensional space. Referring again to Lord Rayleigh's treatise "Duplex Theory of Sound Localization," humans hear sounds coming from different directions as including Interaural Time Difference (ITD) and Interaural Level Difference (ILD). These effects influence the mind's sense of direction, creating a sense of spaciousness and presence. Sound field recording system 100 of the present invention uses ITD and ILD in a manner which differs significantly from traditional stereo recording using traditional types of microphones (e.g., omnidirectional and unidirectional) because the applicant determined that traditional stereo methods did not properly account for the recording user's head. Sound field recording system 100 also overcomes problems with traditional Binaural recording systems and methods by addressing the binaural "Hole in the Middle" effect which comes from making a binaural recording using a static head-shaped binaural microphone support with simulated ear structures which is typically held stationary during a recorded performance, while introducing another binaural flaw arising from the resonances introduced by the dummy head's ear canal and the pinnae (which causes colorations to the sound that are doubled when, on playback, the user hears them again superposed upon the resonances of the listener's own ears. This doubling of resonances produces the above identified harshness in mid to high frequency sounds.

Applicant's sound field recording system 100 and Sonic Presence™ method for sound recording addresses many of the flaws of traditional microphone techniques and binaural by replacing traditional microphones with Spatial Microphone paired transducer assembly 120 to provide a small, highly sensitive wearable system which, when in use embeds the HRTF into a recording while making the recording. Applicant's system 100 and paired spherical acoustic pressure sensor assembly (e.g. 120 or 220) uses two acoustic pressure transducers or omnidirectional microphones (e.g., 130, 140) attached to ear hook supports made of a malleable material (e.g., 132, 142), so the listener can place left and right side transducers (e.g., 130, 140) in front of his or her ear canals to provide a paired transducer assembly 120 that is comfortable to wear and discrete. In contrast to binaural recording methods (which includes placement of the dummy head), the recording wearer positions the left spatial microphone sensor 130 and right spatial microphone sensor 140 in front of the respective ears, preferably against or near the left and right side temples. By moving the transducers 130, 140 in front of the ears (e.g., preferably 12-30 mm in front of the ear canal, and in front of and slightly above the tragus), sound field recording system 100 minimizes the sonic effects of the pinnae whose shape differs widely between individuals. Moving the transducers 130, 140 forward also reduces the recording angle, which enhances the center image and fills in the hole in the middle. The hole in the middle is the chronic binaural problem. The transducers are not inserted into listeners ears like binaural, so there is no ear canal resonance or physical discomfort and the user can enjoy the sound while making a recording.

Figure 7:
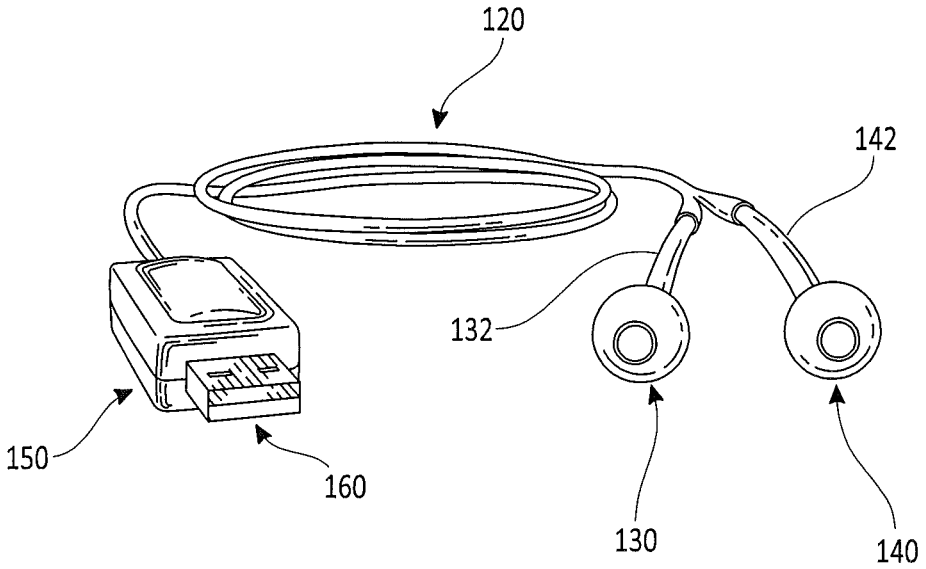
FIG. 7 is a perspective view, in elevation illustrating a USB-compatible embodiment of the paired spherical acoustic pressure sensor assembly of the sound field recording system of the present invention.
Figure 8:
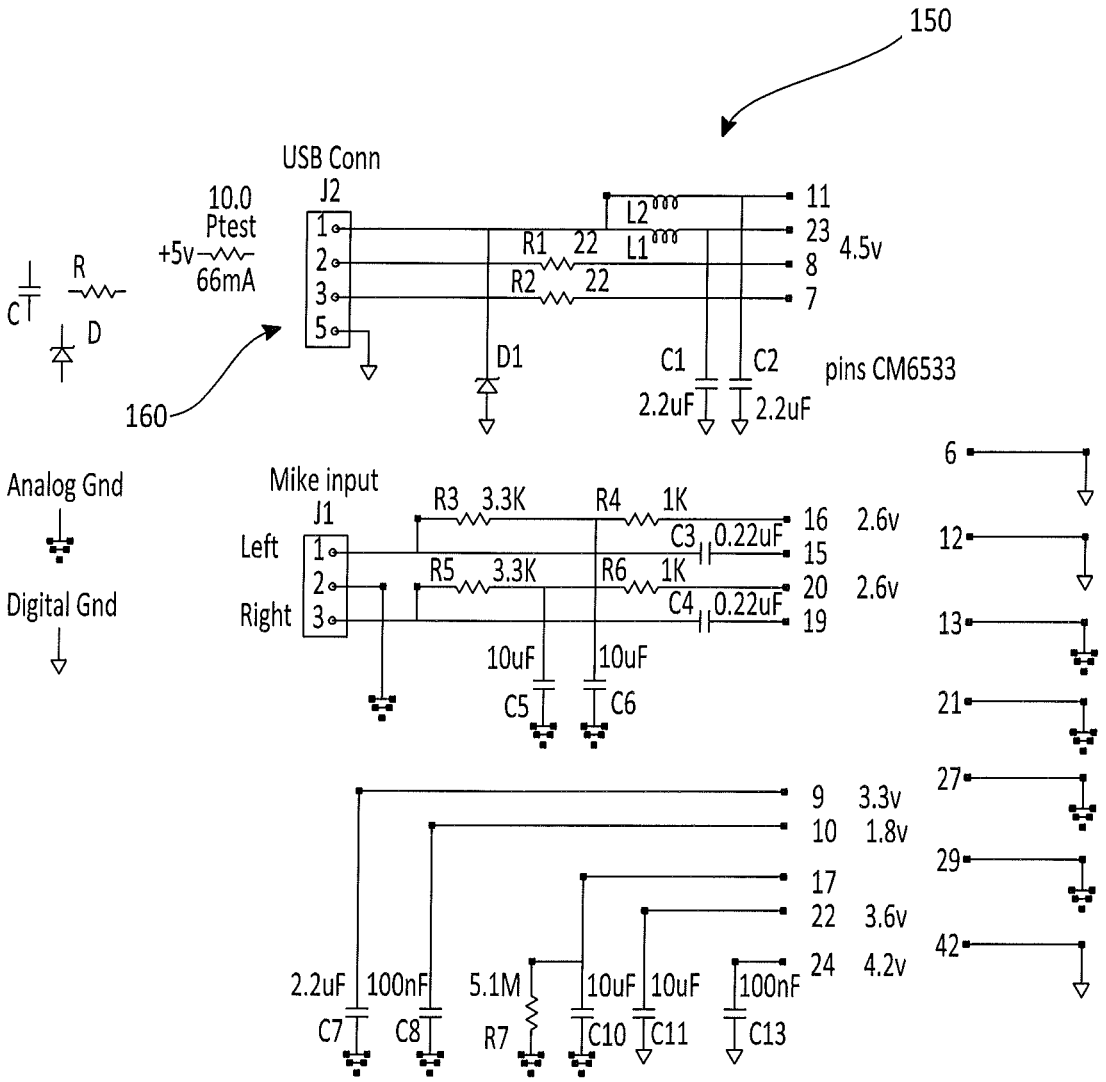
FIG. 8 is a schematic diagram illustrating the circuitry configured within the USB housing for the USB compatible embodiment of the paired spherical acoustic pressure sensor assembly of the sound field recording system of FIG. 7, in accordance with the present invention.
Figure 9:
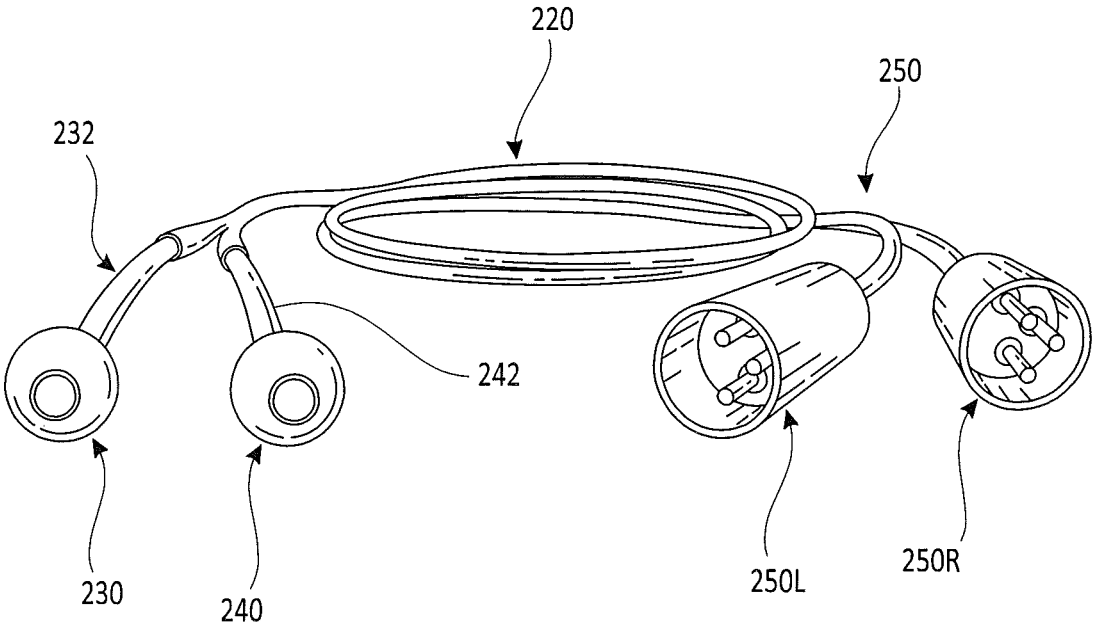
FIG. 9 is a perspective view, in elevation illustrating an XLR compatible embodiment of the paired spherical acoustic pressure sensor assembly of the sound field recording system of the present invention.
Figure 10:
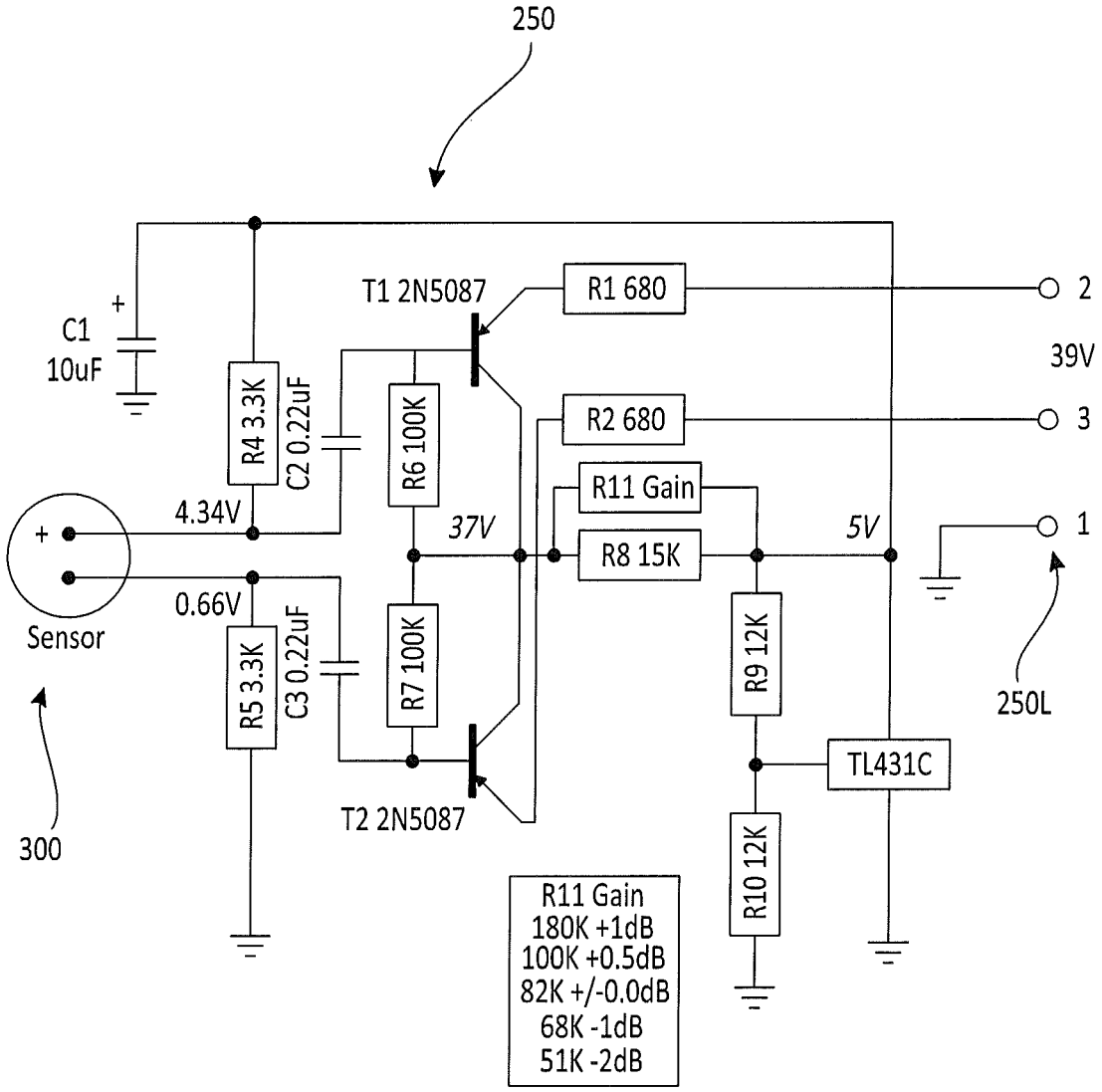
FIG. 10 is a schematic diagram illustrating the phantom powering unit circuitry configured for the Balanced Output XLR compatible embodiment of the paired spherical acoustic pressure sensor assembly of the sound field recording system of FIG. 9, in accordance with the present invention.

Initial prototypes of the paired spherical acoustic pressure sensors were configured in two models: (a) the VR15-USB™ sensor assembly 120 (as illustrated in FIGS. 2, 7 and 8) has a digital interface to the USB serial bus using a DSP system, and (b) the VR15-XLR™ sensor assembly 220 (as illustrated in FIGS. 9 and 10) has a balanced analog interface for use with professional audio recording systems. Another model is configured for interfacing with GoPro™ cameras, and yet another model interfaces to the PIP standard powering used in cameras and video recorders (not shown). Adaptors may be carried separately for use when needed (e.g., iPhone™ Lightning™ to USB Camera Adapter, Android™: Micro USB to USB-A Female OTG Adapter, GoPro™: direct plugin, or XLR direct plugin adapters are readily configured for use with the paired spherical acoustic pressure sensor assembly (e.g., 120).

Persons of skill in the art will recognize that the present invention makes available a sound field recording system 100 and method for sound recording which includes a paired (preferably spherical) acoustic pressure sensor assembly 120 or 220 configured to be suspend with left and right side pressure sensors oriented and aimed on the left and right sides of a wearer's head, in front of the ears, when recording; each of the pressure sensors 130, 140 comprises a miniaturized solid state transducer (e.g., pre-polarized electret mic 300 connected via Mogami™ model 2368 unbalanced cable) affixed within a substantially rigid and solid housing member (e.g., a short segment of 5 mm nylon or carbon tube which is optionally enclosed within a 14 mm sphere made of Delrin™ or a similar dense non-resonant material, defining a lumen therethrough with opposing open ends); and wherein each of the pressure sensors is preferably carried on the distal end of a segment of flexible material 132, 142 which can be shaped by the user to fit over the ear to position the sensor next to the wearer's temple, when in use.

Turning now to FIGS. 13A and 13B, the system and method of the present invention provide an economical and effective way to make Virtual Reality ("VR") audio-visual recordings having ambient soundscapes with an aural perspective which is substantially constant and fixed in relation to a contemporaneous video recording. In the method for creating immersive virtual reality recordings of an environment, performance or event of the present invention, the recording user providing an audio and video recording ("AVR") instrument 400 (e.g., a smartphone such as an iPhone™ or a portable recorder such as a GoPro™ camera) having at least one lens aimed along a lens central axis 420 and audio inputs for a left channel signal and a right channel signal. The recording user employs a spatial microphone audio recording system (with the left sensor 130 configured to be worn in front of the left ear over (and preferably resting against) the left temple and the right sensor 140 in front of the right ear over (and preferably resting against) the right temple). Once the recording user gathers these components, the components are worn, held or mounted (e.g., upon the recording user's body) with the AVR 400 in an orientation which aligns the lens central axis 420 toward a target person, place or thing to be recorded (e.g., music performers aligned in front of the recording user's sternum or chin, when AVR 400 is aimed forwardly).

Next, the recording user installs, puts on or dons the spatial microphone recording system with the left sensor 130 over the left ear and the right sensor 140 over the right ear so that they are (preferably) symmetrically oriented and more or less equally spaced from an imaginary vertical plane bisecting the left and right sides of the wearer's head. Next, the AVR is oriented and aligned so that the AVR lens central (aiming) axis 420 is very nearly in substantial alignment with the vertical plane bisecting the left and right sides of the wearer's head such that the AVR lens is preferably substantially equidistant from the spatial microphone left sensor and the spatial microphone right sensor. Preferably, the three elements (left spatial microphone sensor, right spatial microphone sensor and the AVR are configured to define a system alignment triangle 440 with the spatial microphone sensors just a bit wider than head-width apart (e.g., 7-9 inches apart) and the AVR 420 equally spaced from the spatial microphone sensors 130, 140 and in front of the recording user's sternum (perhaps worn in a pocket or hanging from a chain worn around the neck) or chin (when handheld, in front of the face), so the AVR is preferably about 10-14 inches away from each spatial microphone sensor.

At the moment the recording user begins a VR recording of an environment, performance, event, target person, place or thing, the recording user maintains the tringle configuration as constantly as possible for the duration of the VR recording. It is important that for the selected duration of the VR recording, the recording user (or, alternatively, a fixture) maintains the relative positions of the AVR lens central axis to the SP left sensor and the SP right sensor such that there is substantially no change in the direction or distances between said AVR lens, said AVR lens central axis, the distance from said AVR lens to said SP left sensor and the distance from said AVR lens to said SP right sensor. This configuration, if substantially maintained, provides a VR recording which has, for the entire duration of the recording, a substantially constant and fixed aural perspective which an audience member viewing and hearing the VR recording will recognize as placing seen objects in a sound-field such that (a) moving objects in the VR recording's image are aurally tracked in the VR recording's audio playback and (b) moving (e.g., panning right) perspectives seen in the VR recording's image are continuously aurally tracked in the VR recording's audio playback (e.g., so something audible which was seen as straight ahead initially, upon panning right is heard moving continuously into the audience member's left ear's hearing and away from the right ear).

Applicant's development work with the system and method of the present invention has revealed that these VR recordings, upon playback, provide the substantially constant and fixed aural perspective which audience members recognize as placing seen objects in an immersive sound-field such that moving objects in the VR recording's image are aurally tracked in the VR recording's audio playback when the objects move out of the visual frame. Those objects, now heard but not seen, move into an imagined space which is to the left, or to the right, or overhead or behind the audience member so that the audience member experiences a substantially continuous immersive VR audio-video playback experience.

Having described and illustrated preferred embodiments of a new and improved system 100 and method, it is believed that other modifications, variations and changes will be suggested to those skilled in the art in view of the teachings set forth herein. It is therefore to be understood that all such variations, modifications and changes are believed to fall within the scope of the present invention as set forth in the claims.

The invention claimed is:

1. A sound field recording system comprising:

a paired acoustic pressure sensor assembly including a left side pressure sensor and a right side pressure sensor, said pressure sensor assembly being configured to be worn by a recording user or wearer with said left side pressure sensor and said right side pressure sensor being oriented and aimed from the respective left and right sides of a wearer's head, on or proximate the wearer's left and right temples, and suspended in front of the wearer's ears, when recording;

wherein each of said left side pressure sensor and a right side pressure sensor comprises a miniature solid state transducer affixed within a substantially rigid and hollow housing member; wherein each of said left side pressure sensor housing member and said right side pressure sensor housing member is carried on the distal end of a cable temple defining ear hook member made from a segment of malleable material configured to be shaped by the wearer to fit over an ear to position one of the sensor housing members next to each of the wearer's temples, in front of the ear canal and in front of the tragus, when in use; and wherein each of said left side pressure sensor and a right side pressure sensor comprises a miniaturized solid state electret microphone affixed within a substantially spherical hollow housing member defining a lumen therethrough with opposing open ends; and wherein each of said left side pressure sensor housing member and said right side pressure sensor housing member is configured with said miniature solid state transducer affixed within a substantially rigid hollow tube segment which is enclosed within a hollow 10-14 mm sphere made of nylon or a similar dense non-resonant material.

2. The sound field recording system of claim 1, wherein each of said left side pressure sensor housing member and said right side pressure sensor housing member is carried at the distal end of a corresponding malleable cable temple defining ear hook member which defines a lumen therein and wherein each malleable cable temple defining ear hook member has a proximal end lumen configured to receive a thin, flexible cable connected within said rigid sphere to said transducer wherein each of said left side pressure sensor housing member and said right side pressure sensor housing member are configured with a corresponding malleable cable temple defining ear hook member defining a lumen therethrough with opposing open ends, with the sensing surface of the transducer proximate the open distal end of the housing sphere's lumen.

3. The sound field recording system of claim 1, further comprising an audio and video recording instrument having at least one lens aimed along a lens central axis and a left audio input for a left channel signal and a right audio input for a right channel signal;

wherein said paired acoustic pressure sensor assembly's left side pressure sensor is connected to said left audio input and said right side pressure sensor is connected to said right audio input.

4. The sound field recording system of claim 3, wherein said paired acoustic pressure sensor assembly includes a standardized interface or connector configured for connection with said audio and video recording instrument.

5. The sound field recording system of claim 4, paired acoustic pressure sensor assembly includes a USB connector configured for connection with said audio and video recording instrument.

* * * * *